US010743662B2

(12) United States Patent
Li et al.

(10) Patent No.: US 10,743,662 B2
(45) Date of Patent: Aug. 18, 2020

(54) STORAGE DEVICE AND REFRIGERATOR HAVING THE SAME

(71) Applicant: QINGDAO HAIER CO., LTD., Qingdao, Shandong Province (CN)

(72) Inventors: Dengqiang Li, Qingdao (CN); Bin Fei, Qingdao (CN); Yazhou Shang, Qingdao (CN); Xueli Cheng, Qingdao (CN)

(73) Assignee: QINGDAO HAIER CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 16/486,146

(22) PCT Filed: Nov. 15, 2018

(86) PCT No.: PCT/CN2018/115579
§ 371 (c)(1),
(2) Date: Aug. 14, 2019

(87) PCT Pub. No.: WO2019/100995
PCT Pub. Date: May 31, 2019

(65) Prior Publication Data

US 2019/0357679 A1 Nov. 28, 2019

(30) Foreign Application Priority Data

Nov. 21, 2017 (CN) ..... 2017 1 1168709

(51) Int. Cl.
*A47B 88/975* (2017.01)
*F25D 25/02* (2006.01)

(52) U.S. Cl.
CPC ..... *A47B 88/975* (2017.01); *F25D 25/022* (2013.01); *F25D 2325/021* (2013.01)

(58) Field of Classification Search
CPC ... A47B 88/975; A47B 88/994; F25D 25/022; F25D 25/025; F25D 2325/011; F25D 2325/021; F25D 23/069
See application file for complete search history.

(56) References Cited

U.S. PATENT DOCUMENTS 2,615,592 A * 10/1952 Swedman ..... F25D 25/022 220/529
3,468,592 A * 9/1969 Madey ..... A47F 3/142 312/140.3

(Continued)

FOREIGN PATENT DOCUMENTS

CN 2881483 Y 3/2007
CN 106839634 A 6/2017

(Continued)

*Primary Examiner* — Patrick D Hawn
(74) *Attorney, Agent, or Firm* — Cheng-Ju Chiang

(57) ABSTRACT

The present invention discloses a storage device and a refrigerator having the same. The storage device comprises a body, a pair of guiding mechanisms and a first partition frame, wherein the pair of guiding mechanisms is arranged at a pair of side walls of the body and comprises guiding elements which slide back and forth with respect to the body; the first partition frame comprises a partition element, fixing portions and a limited portion, the fixing portions are provided to be long rods extending in a front-rear direction and are formed at two ends of the first partition frame; the first partition frame is connected onto the guiding element by the fixing portion, and the limiting portion is fitted and connected with the limited portion, such that the first partition frame is prevented from moving back and forth with respect to the guiding element.

9 Claims, 11 Drawing Sheets

(56) References Cited

U.S. PATENT DOCUMENTS 4,703,982 A * 11/1987 Rock ..... A47B 88/994 312/330.1
5,806,941 A * 9/1998 Diederich ..... B42F 17/14 220/542
6,871,921 B2 * 3/2005 Ernst ..... A47B 88/994 312/348.3
6,938,784 B2 * 9/2005 Yang ..... A47B 88/00 211/87.01
7,296,433 B2 * 11/2007 Uihlein ..... F25D 23/021 62/441
8,590,992 B2 * 11/2013 Lim ..... F25D 25/025 312/404
8,733,867 B2 * 5/2014 Hwang ..... F25D 25/025 312/402
8,789,903 B2 * 7/2014 Lim ..... F25D 25/025 312/404
8,833,881 B2 * 9/2014 Manniso ..... A47B 88/994 312/348.3
9,057,555 B2 * 6/2015 Moody ..... A47B 57/58
9,072,378 B2 * 7/2015 Baum ..... F25D 25/025
9,103,579 B2 * 8/2015 Lim ..... F25D 25/025
9,207,011 B2 * 12/2015 Song ..... F25D 25/025
9,347,704 B2 * 5/2016 Mok ..... F25D 25/025
9,534,833 B2 * 1/2017 Choi ..... F25D 25/022
10,240,856 B2 * 3/2019 Park ..... F25D 25/025
10,436,500 B2 * 10/2019 Jo ..... F25D 23/062
2004/0155564 A1 * 8/2004 Berger ..... A47B 88/994 312/348.3
2005/0218763 A1 * 10/2005 Bisson ..... A47B 88/975 312/348.1
2010/0319391 A1 * 12/2010 Lim ..... F25D 25/025 62/441
2011/0285266 A1 * 11/2011 Rotter ..... F25D 25/025 312/402
2013/0063014 A1 * 3/2013 Chen ..... A47B 88/975 312/348.3
2014/0049149 A1 * 2/2014 Lim ..... F25D 25/025 312/404
2014/0312759 A1 * 10/2014 Song ..... F25D 25/025 312/405.1
2018/0116399 A1 * 5/2018 Lee ..... A47B 88/975
2018/0149415 A1 * 5/2018 Jo ..... F25D 23/069

FOREIGN PATENT DOCUMENTS

CN 206648399 U 11/2017
KR 10-1299065 B1 8/2013

* cited by examiner

STORAGE DEVICE AND REFRIGERATOR HAVING THE SAME

The present application is a 35 U.S.C. § 371 National Phase conversion of International (PCT) Patent Application No. PCT/CN2018/115579, filed on Nov. 15, 2018, which claims priority to Chinese Patent Application No. 201711168709.2, filed on Nov. 21, 2017 and titled "STORAGE DEVICE AND REFRIGERATOR HAVING THE SAME", which is incorporated herein by reference in its entirety. The PCT International Patent Application was filed and published in Chinese.

TECHNICAL FIELD

The invention relates to a storage device and a refrigerator having the same, pertaining to the field of household appliances.

BACKGROUND

A storage device of a refrigerator, such as a drawer, a crisper, a storage box, a bottle rack, or the like, generally has a large accommodation cavity. A variety of food tends to be in a mess when placed therein, which is very inconvenient to take and place food. In particular, the various food is adhered one another when are placed and adhered one another in a drawer of the freezing compartment, which is more inconvenient to take out food from the drawer of the freezing compartment of the refrigerator.

In order to solve the above-mentioned problems, some manufacturers divide the accommodation cavity of the storage device by a partition frame, but such partition frames may only simply divide the accommodation cavity, without freely adjusting partition spaces according to stored articles, with poor flexibility; moreover, with a complicated assembly structure, the partition frame is not easy to disassemble or assemble; the stored articles in different partition spaces tend to slide down and be chaotic, failing to achieve an effect of division.

SUMMARY

The present invention aims to solve at least one of the technical problems existing in the prior art. To achieve the above objective, the present invention provides a storage device and a refrigerator having the same.

To fulfill said objective of the present invention, the present invention provides a storage device. The storage device comprises a body enclosing an accommodation cavity, a pair of guiding mechanisms and a first partition frame for dividing the accommodation cavity, the body comprising a bottom wall, a pair of first side walls and a pair of second side walls, wherein the pair of guiding mechanisms is arranged at the pair of second side walls respectively, the guiding mechanism comprises a guiding element which slides back and forth with respect to the body, the guiding element comprises a mounting portion and a limiting portion; the first partition frame comprises a partition element, fixing portions and a limited portion, the partition element extends in a left-right direction, for dividing the accommodation cavity, the fixing portions are provided to be long rods extending in a front-rear direction and are formed at two ends of the first partition frame; wherein the fixing portions are fitted and connected with the mounting portion, such that the first partition frame is connected onto the guiding element, and the limiting portion is fitted and connected with the limited portion, such that the first partition frame is prevented from moving back and forth with respect to the guiding element.

Further, the fixing portion and the limited portion are connected to form an L-shaped structure.

Further, the mounting hole is provided to be a mounting hole extending in the front-rear direction, the fixing portion is inserted into the mounting hole in a first direction, and the first direction is parallel to the front-rear direction.

Further, the guiding element comprises a first guiding element and a second guiding element, the mounting hole is formed on the first guiding element; when the fixing portion is inserted and fitted into the mounting hole, the limiting portion is formed between the first and second guiding elements, and the first and second guiding elements jointly restrict the first partition frame from moving back and forth with respect to the guiding element.

Further, the guiding mechanism is provided at the exterior of the body away from the accommodation cavity, a guide groove extending in the front-rear direction is provided on the second side wall, and the fixing portion passes through the guide groove from the accommodation cavity and then is inserted and fitted into the mounting hole.

Further, the fixing portion is connected with the limited portion to form a T-shaped structure.

Further, the guiding element comprises a guiding body, a hook extending out of the guiding body, a mounting groove enclosed by the hook for constituting the mounting portion, and an opening, wherein the mounting groove extends in the front-rear direction, the fixing portion is fastened into the mounting groove through the opening in the first direction, and the first direction is perpendicular to the front-rear direction.

Further, the limiting portion is a U-shaped notch which is recessed on the hook from the opening, and when the fixing portion is fastened in the mounting groove, the limited portion is fitted into the notch.

Further, the hook is provided to be an elastic structure; the fixing portion is provided to be a cylindrical bar with a diameter of D; in the first direction, an aperture of the opening decreases gradually to a minimal value W, wherein $W<D$.

In addition, the present invention further provides a refrigerator comprising the storage device.

Compared with a prior art, the present invention has the following advantageous effects. By providing a structure in which a first partition frame is coordinated with a guiding element, not only the degree of freedom and flexibility of dividing an accommodation cavity are improved to meet different storage demands, but also the assembly/disassembly is convenient, and the stability during movement is high.

Figure 4A:
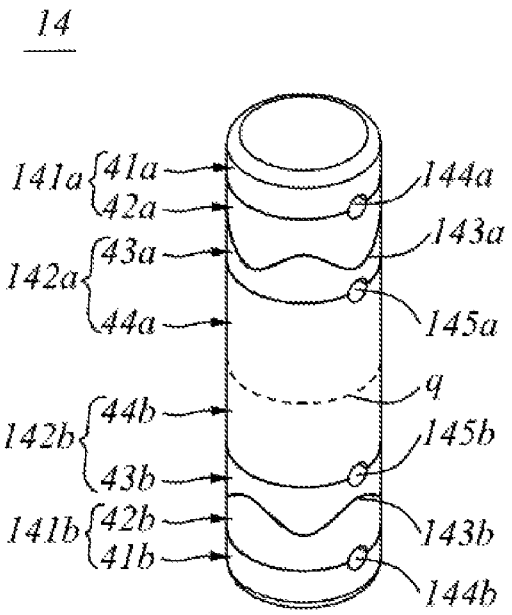
Figure 4B:
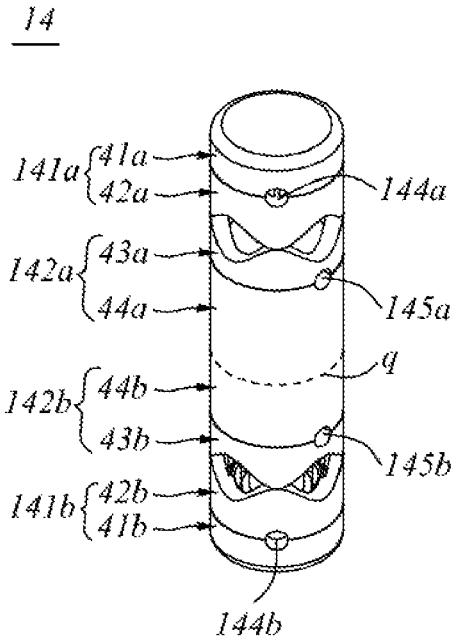
Figure 4C:
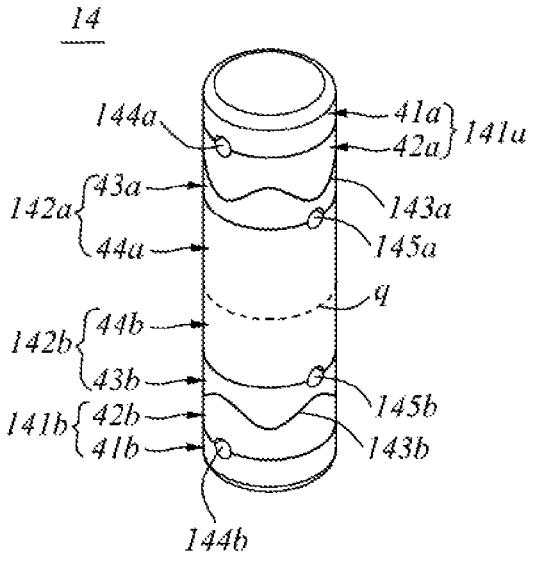
Figure 5:
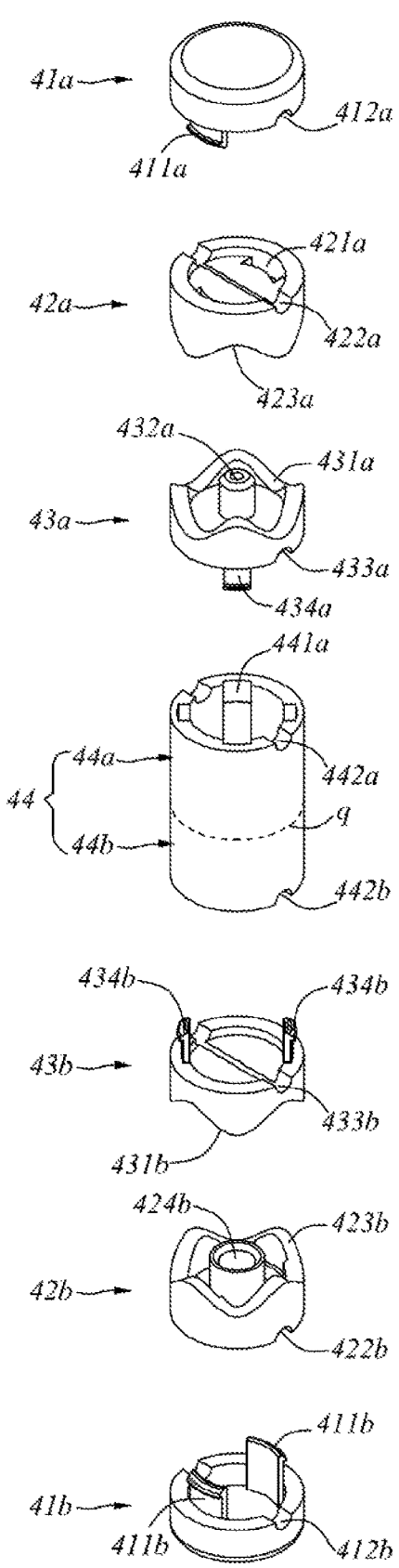
Figure 6A:
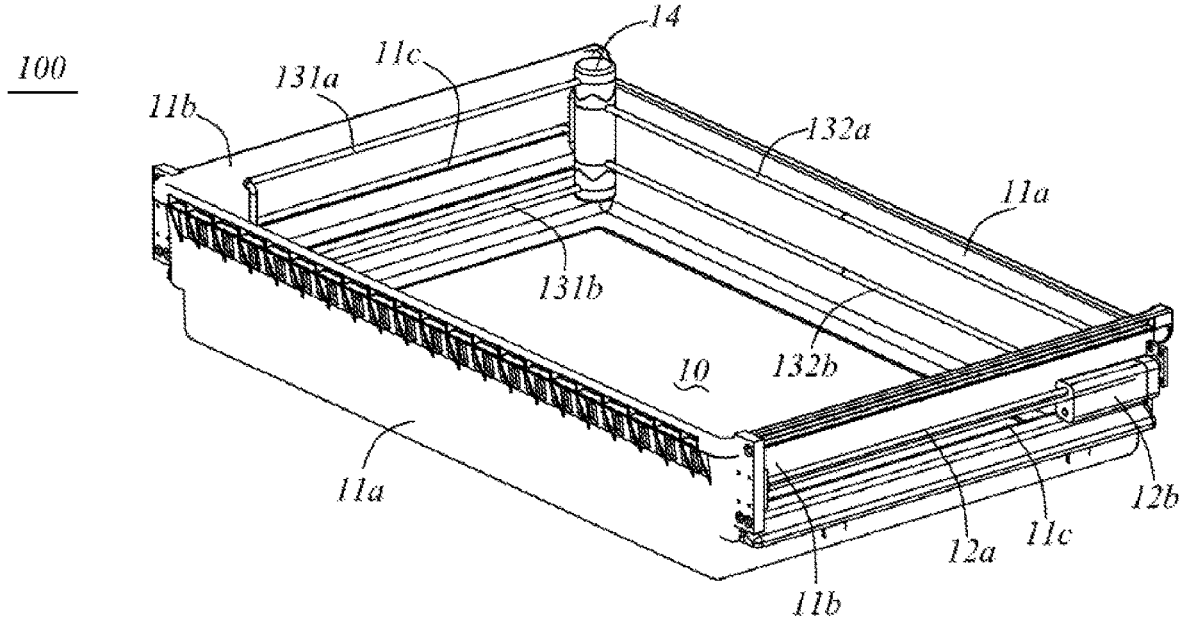
Figure 6B:
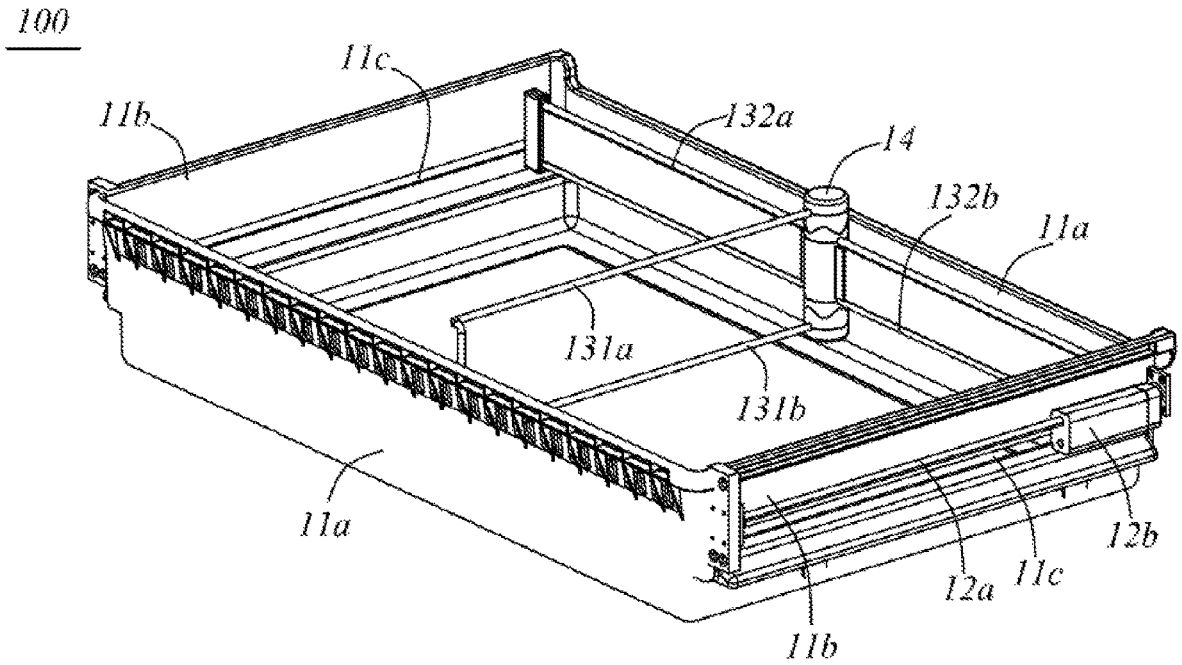
Figure 6C:
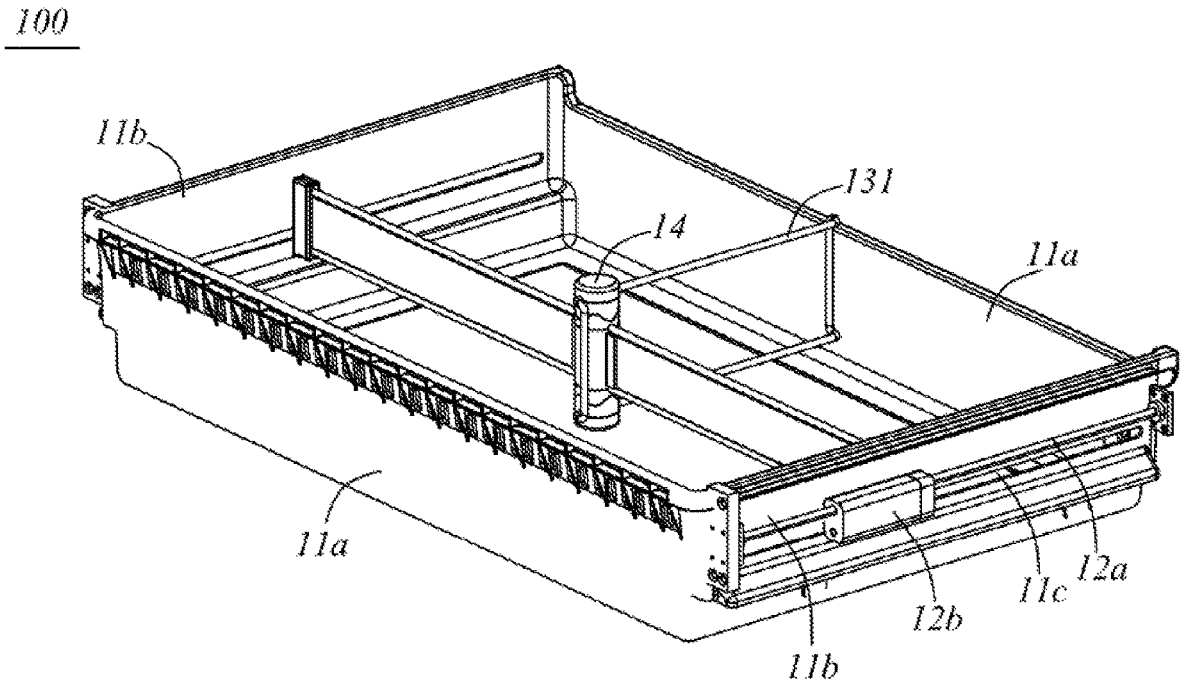
Figure 7:
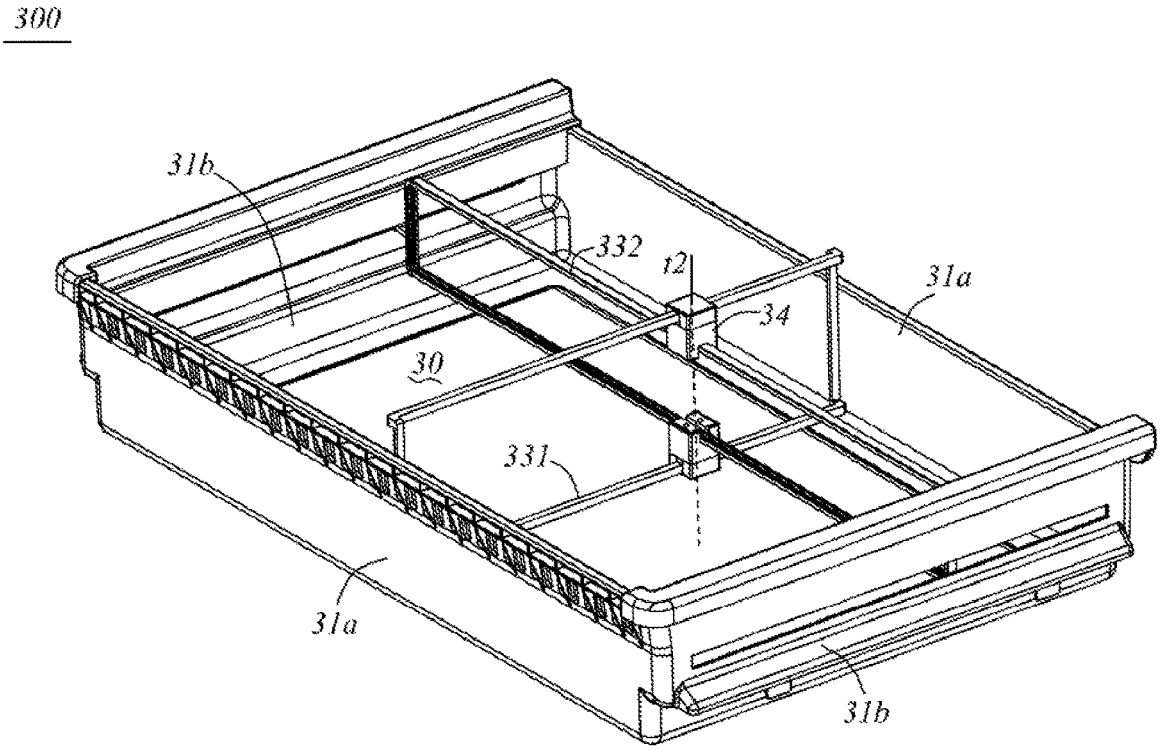
Figure 8:
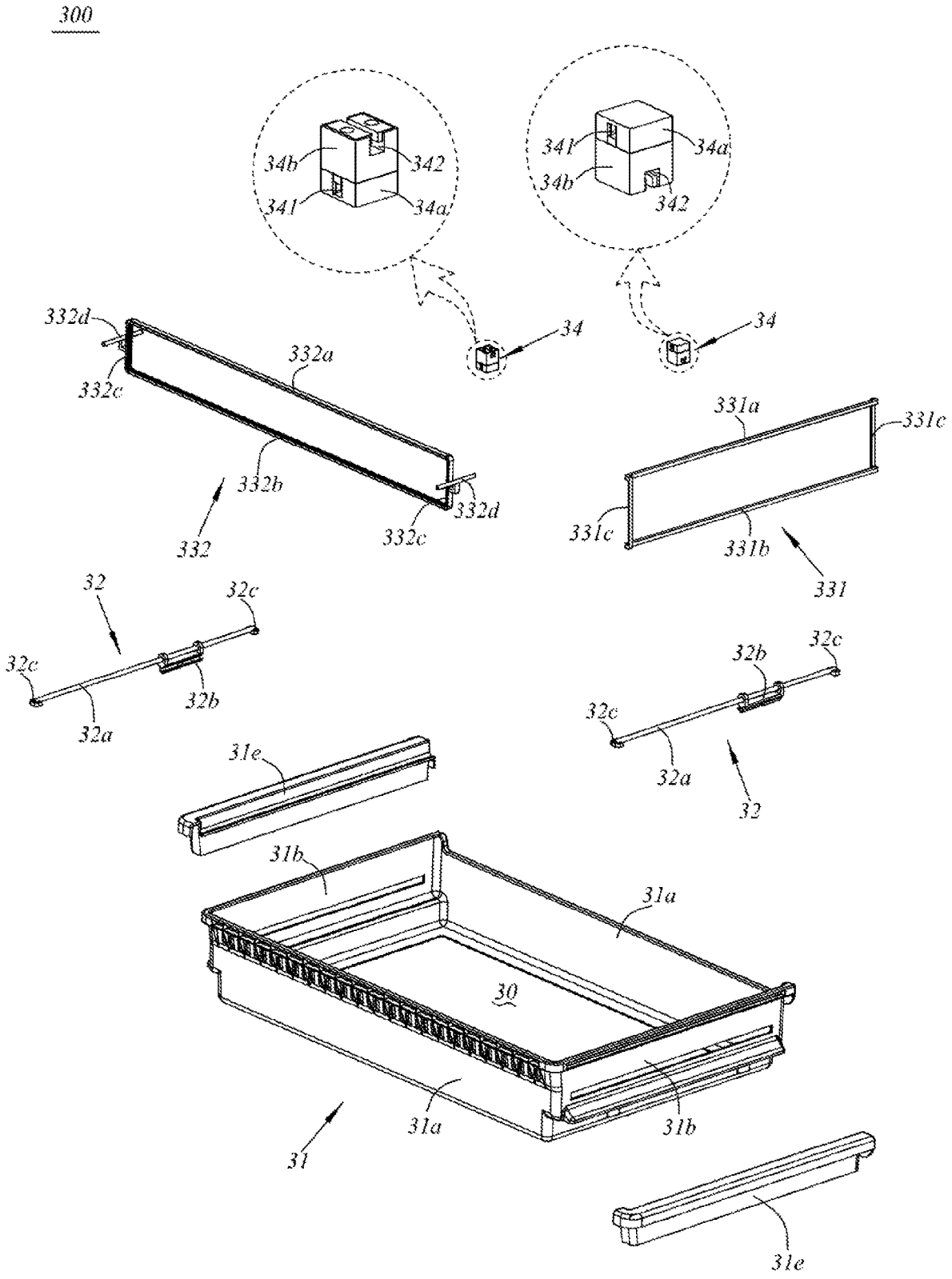
Figure 9:
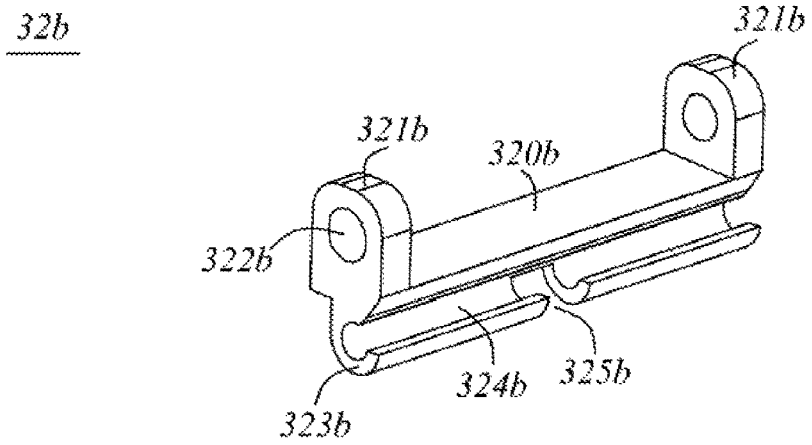
Figure 10:
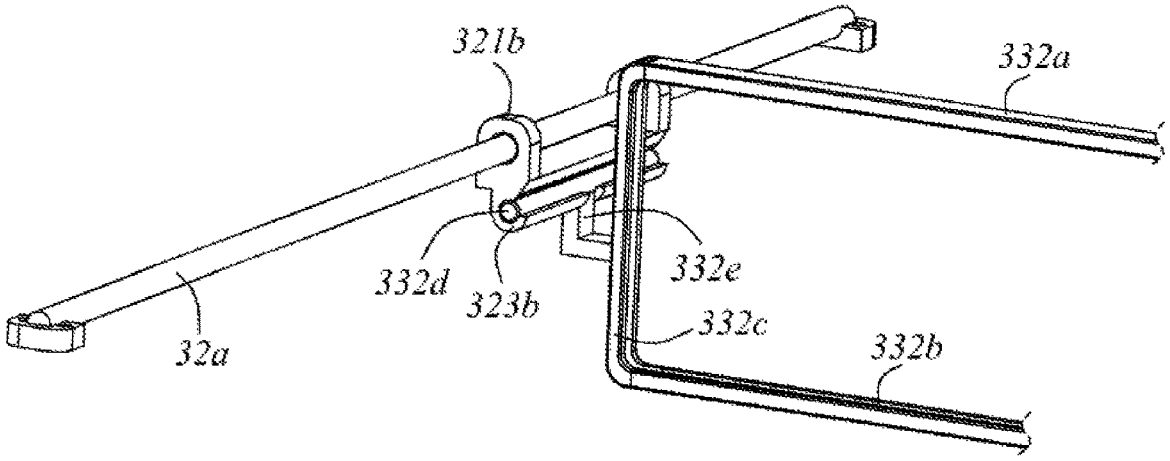
Figure 11:
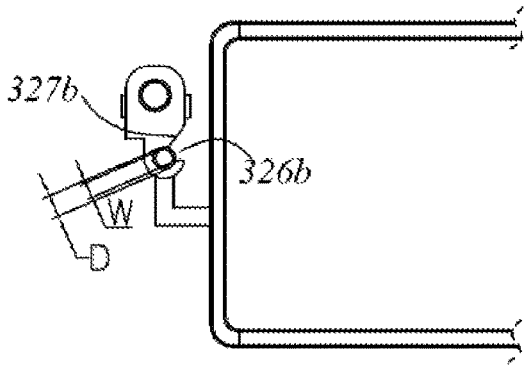
Figure 12:
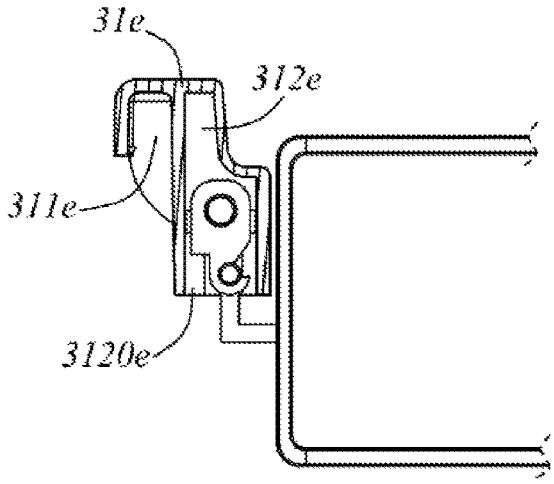
Figure 13:
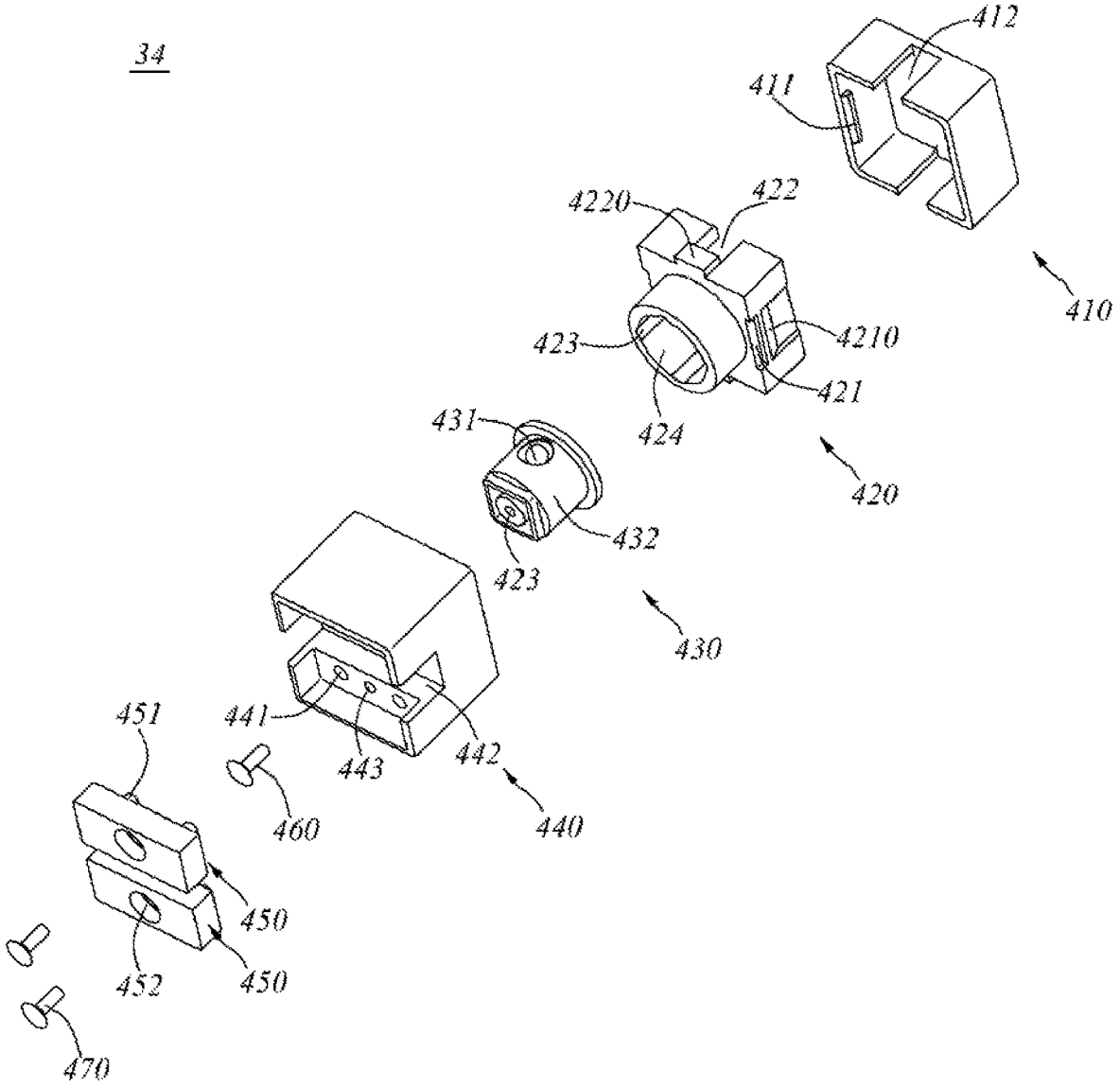
Figure 14:
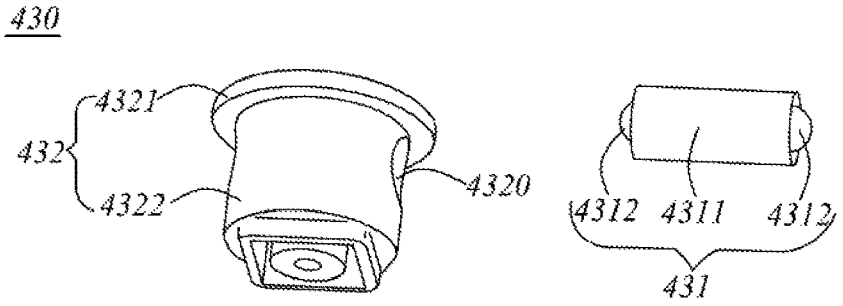
Figure 15A:
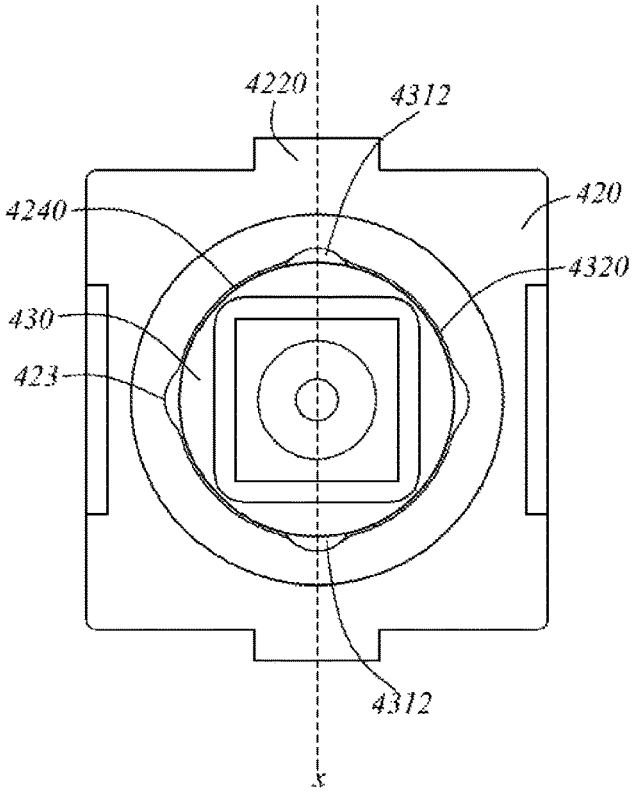
Figure 15B:
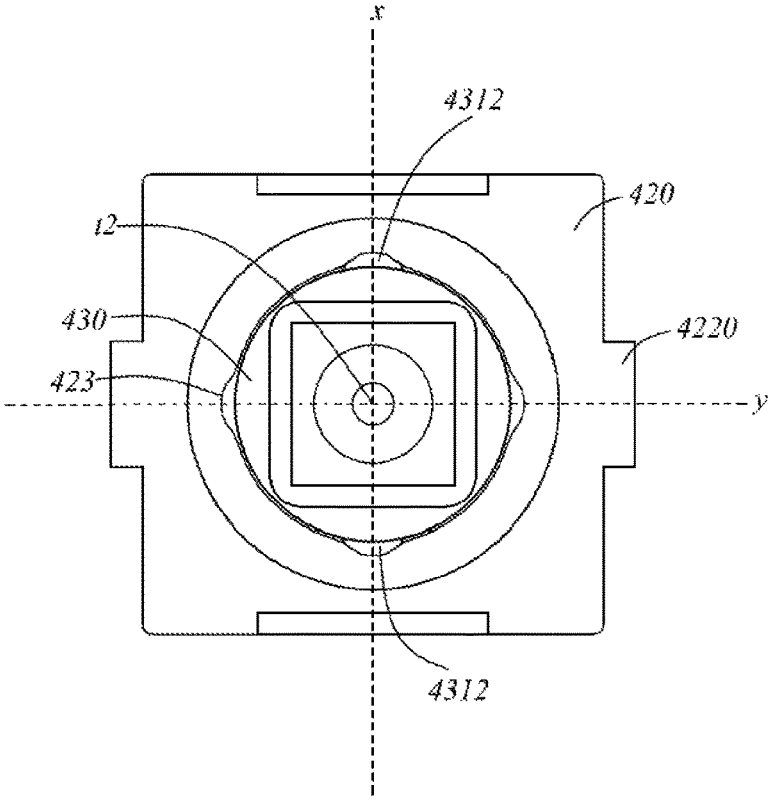

FIG. **4*a*** is a structural diagram when a regulating assembly according to the first embodiment of the present invention is in a first engaged state;

FIG. 4*b* is a structural diagram of the regulating assembly according to the first embodiment of the present invention in a critical state;

FIG. 4*c* is a structural diagram when the regulating assembly according to the first embodiment of the present invention is in a second engaged state;

FIG. 5 is a structural exploded diagram of the regulating assembly according to the first embodiment of the present invention;

FIG. 6*a* is a structural diagram of the storage device according to the first embodiment of the present invention, which shows a state when the accommodation cavity has no partition;

FIG. 6*b* is a structural diagram of the storage device according to the first embodiment of the present invention, which shows a state when the accommodation cavity has two partitions;

FIG. 6*c* is a structural diagram of the storage device according to the first embodiment of the present invention, which shows a state when the accommodation cavity has three partitions;

FIG. 7 is a structural diagram of a storage device in an unfolded state according to a second embodiment of the present invention;

FIG. 8 is a structural exploded diagram of the storage device according to the second embodiment of the present invention;

FIG. 9 is a schematic structural diagram of a guiding element according to the second embodiment of the present invention;

FIG. 10 is a schematic diagram of a state in which a guiding mechanism is coordinated with a first partition frame according to the second embodiment of the present invention;

FIG. 11 is a sectional view of a state in which the guiding mechanism is coordinated with the first partition frame according to the second embodiment of the present invention;

FIG. 12 is a sectional view of the guiding mechanism, the first partition frame and an auxiliary element according to the second embodiment of the present invention;

FIG. 13 is a structural exploded diagram of a regulating assembly according to the second embodiment of the present invention;

FIG. 14 is a structural exploded diagram of a pivot member according to the second embodiment of the present invention;

FIG. 15*a* is a structural diagram of a state in which the pivot member is coordinated with a sleeve member when the storage device is in a folded state according to the second embodiment of the present invention; and FIG. 15*b* is a structural diagram of a state in which the pivot member is coordinated with the sleeve member when the storage device is in the unfolded state according to the second embodiment of the present invention.

DETAILED DESCRIPTION

An embodiment of the present invention provides a refrigerator, including a box body and a door, the box body and the door defining at least one storage compartment, which may be a refrigerating compartment, a freezing compartment, a multi zone, or the like. The refrigerator further includes a storage device for storing articles, which is provided in the storage compartment and may be specifically configured as a drawer, a crisper, a storage box, a bottle rack, and the like. Hereinafter, the storage device according to the present invention will be described in detail in conjunction with specific embodiments.

Embodiment 1

Referring to FIGS. 1 to 6*c*, the present embodiment provides a storage device 100, including a body 11, a pair of guiding mechanisms 12, a first partition frame 132, a second partition frame 131 and a regulating assembly 14.

Enclosed by the body 11, an accommodation cavity 10 has an upper opening and is rectangular parallelepiped substantially, for storing various articles, such as food, beverage, or the like. The body 11 includes a bottom wall, a pair of first side walls 11*a* arranged opposite to each other, and a pair of second side walls 11*b* arranged opposite to each other. The bottom wall is configured for carrying articles, and the pair of first side walls 11*a* and the pair of second side walls 11*b* extend perpendicularly upwards from the bottom wall respectively.

In order to clearly express the position and direction described in the present embodiment, the direction defined by a relative position of the pair of first side walls 11*a* is referred to as a front-rear direction (also as a longitudinal direction), and the direction defined by a relative position of the pair of second side walls 11*b* is referred to as a left-right direction (also as a lateral direction). That is, the pair of first side walls 11*a* is arranged front to back, and the pair of second side walls 11*b* is arranged left and right. In addition, the plane defined both by the front-rear direction and the left-right direction is defined as a horizontal plane, and the direction perpendicular to the horizontal plane is defined as a vertical direction.

Figure 1:
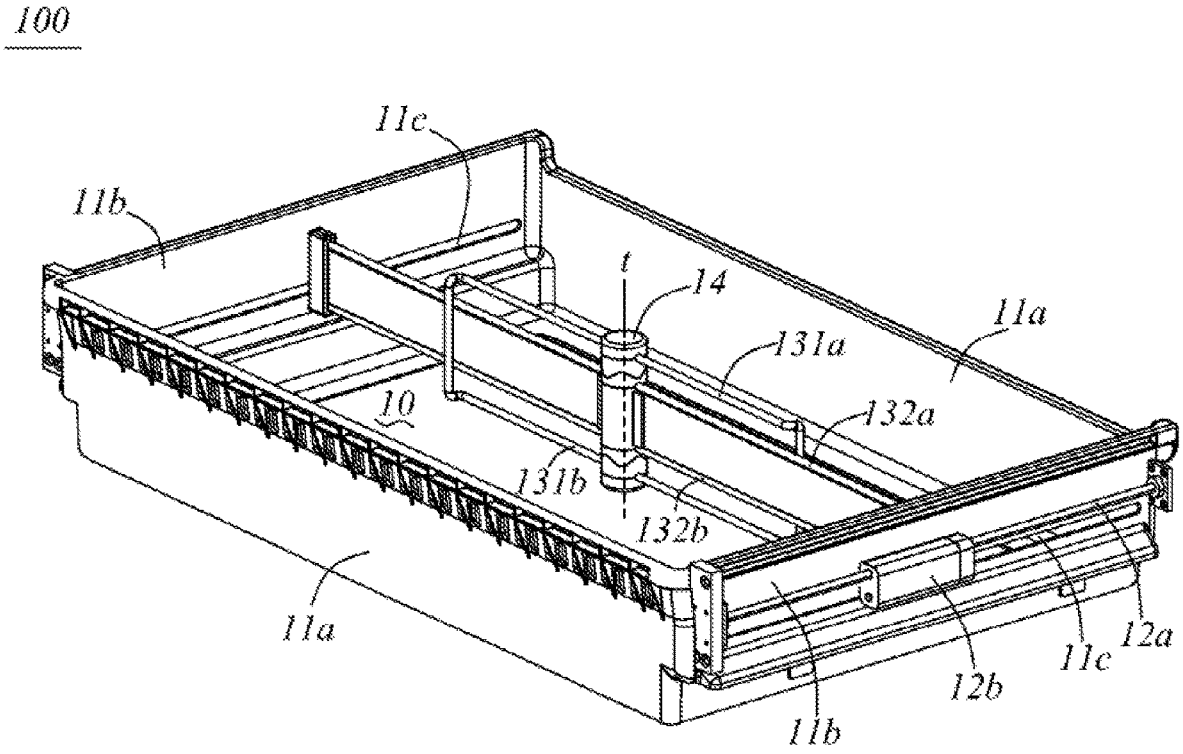
FIG. 1 is a structural diagram of a storage device according to a first embodiment of the present invention, wherein the storage device is in a folded state.
Figure 2:
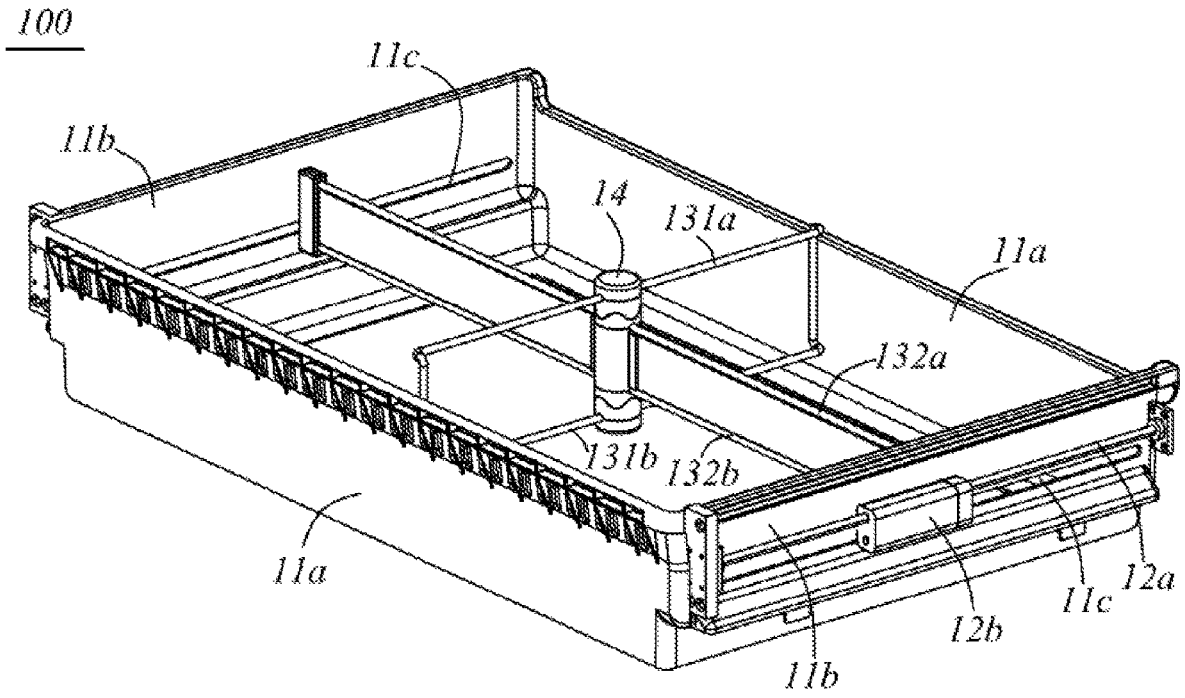
FIG. 2 is a structural exploded diagram of the storage device according to the first embodiment of the present invention.
Figure 3:
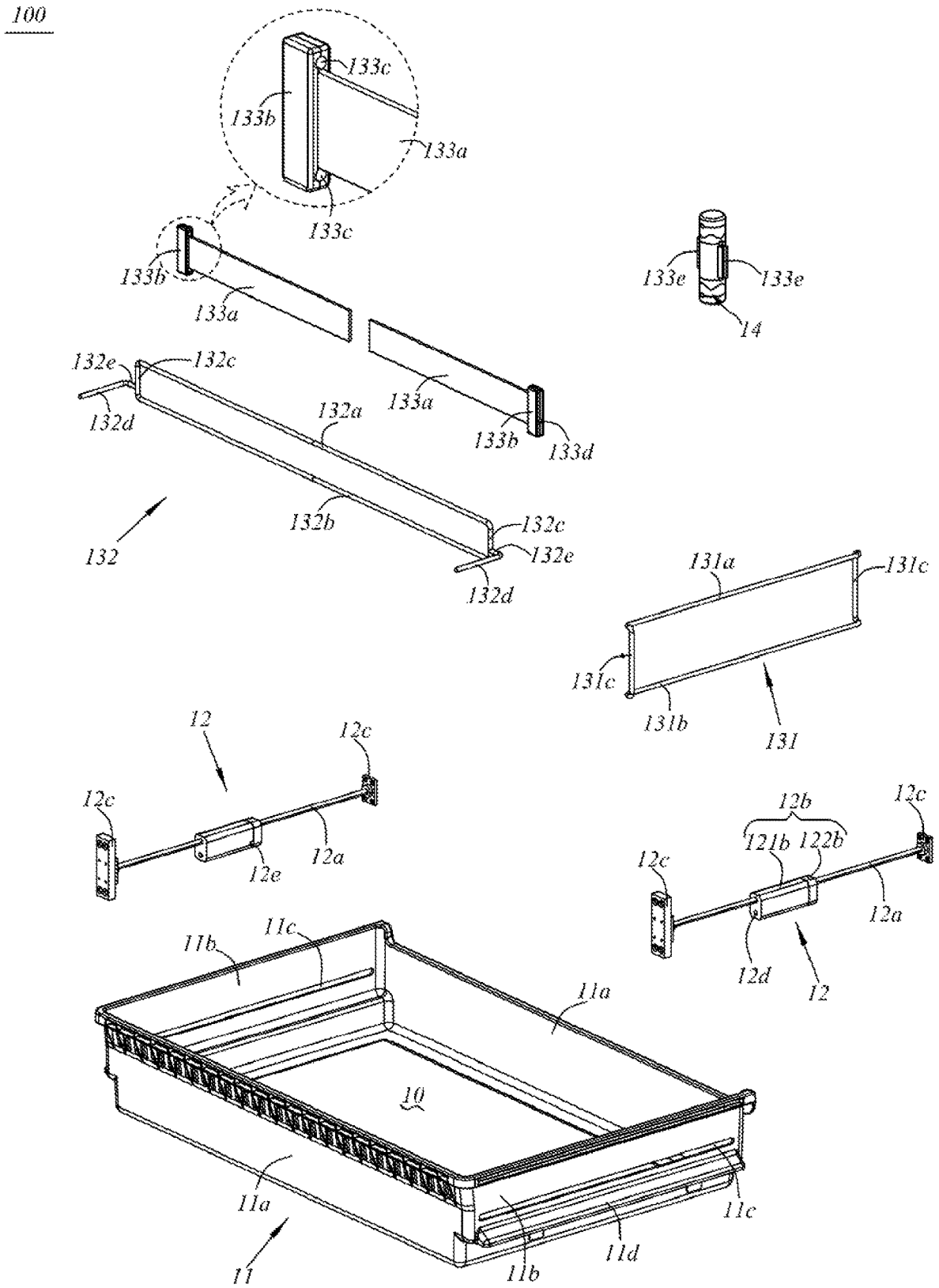
FIG. 3 is a structural diagram of the storage device according to the first embodiment of the present invention, wherein the storage device is in an unfolded state.

Referring to FIGS. 1 and 2, the pair of guiding mechanisms 12 is arranged on the pair of second side walls 11*b* respectively. Referring to FIG. 3, the guiding mechanism 12 includes a guide bar 12*a*, a guiding element 12*b* and fixing bases 12*c*, wherein the guiding mechanism 12 is fixed on the body 11 through the fixing bases 12*c*, the fixing bases 32*c* are fixed with the body 11 in a threaded connection, rivet connection, fastener connection, or the like; parallel with the second side wall 11*b*, the guide bar 12*a* extends in the front-rear direction; the guide bar 12*a* is sleeved with the guiding element 12*b*, the guiding element 12*b* may slide back and forth along the guide bar 12*a*; when the guiding mechanism 12 is fixed to the body 11, the guiding element 12*b* may only slide back and forth with respect to the body 11.

The first partition frame 132 is accommodated in the accommodation cavity 10, for dividing the accommodation cavity 10 in the front-rear direction. Specifically, the first partition frame 132 includes a partition element laterally arranged in the accommodation cavity 10 for dividing the accommodation cavity 10, the vertical plane where the partition element is located is defined as a partition plane of the first partition frame 132, and the accommodation cavity 10 is divided in the front-rear direction by taking the partition plane of the first partition frame 132 as a boundary. In the present embodiment, the partition element includes long transverse partition bars 132*a* and 132*b* which extend left and right and are arranged spaced apart from each other in the vertical direction.

The first partition frame 132 further includes a pair of connectors 132*c* which is configured for connecting an end portion of the transverse partition bar 132*a* with an end portion of the transverse partition bar 132*b*, and enclosing a rectangular frame together with the transverse partition bars 132*a*, 132*b*.

The first partition frame 132 is slidably connected onto the body 11 in the front-rear direction through the guiding mechanism 12, for adjusting the size and/or number of the storage partitions formed by dividing the accommodation cavity 10 in the front-rear direction.

Specifically, the first partition frame 132 includes a pair of fixing portions 132*d* formed at the left and right ends of the first partition frame 132 and a limited portion 132*e*; the guiding element 12*b* includes a first guiding element 121*b*, a second guiding element 122*b*, a mounting portion and a limiting portion 12*e*.

The fixing portion 132*d* is specifically provided in shape of a long bar extending in the front-rear direction, and the mounting portion is provided to be a mounting hole 12*d* extending in the front-rear direction, the fixing portion 132*d* is insertably fitted into the mounting portion 12*d* in the first direction parallel with the front-rear direction, and the first direction is a forward horizontal direction in the present embodiment. When the fixing portion 132*d* is inserted into the mounting hole 12*d*, the first partition frame 132 is slidably connected onto the guiding element 12*b* synchronously, and at this point, the fixing portion 132*d* and the mounting hole 12*d* are limited mutually in the left-right direction, so that the fixing portion 132*d* cannot move left and right with respect to the guiding element 12*b*.

The limiting portion 12*e* is matched with the limited portion 132*e*. When the fixing portion 132*d* is insertably fitted into the mounting hole 12*d*, the limiting portion 12*e* is fitted and connected with the limited portion 132*e* to limit the back-and-forth movement of the first partition frame 132 with respect to the guiding element 12*b*. In this way, the first partition frame 132 may be stably connected with the guiding element 12*b* to prevent the first partition frame 132 from shaking.

In the present embodiment, the fixing portion 132*d* and the limited portion 132*e* are connected with each other to form an L-shaped structure.

The first guiding element 121*b* and the second guiding element 122*b* are separately provided, and the first and second guiding elements 121*b* and 122*b* are detachably assembled with each other. The mounting hole 12*d* is provided on the first guiding element 121*b*. When the first and second guiding elements 121*b* and 122*b* are separated from each other, the fixing portion 132*d* may be inserted into the mounting hole 12*d* from between the first and second guiding elements 121*b* and 122*b*; when the fixing portion 132*d* is inserted into the mounting hole 12*d* and the first and second guiding elements 121*b* and 122*b* are assembled with each other, the limiting portion 12*e* is formed between the first and second guiding elements 121*b* and 122*b* (i.e., the limiting portion 12*e* is enclosed by the first and second guiding elements 121*b* and 122*b*), the limited portion 132*e* is fitted into the limiting portion 12*e*, and the first and second guiding elements 121*b* and 122*b* are butted against the limited portion 132*e* from front and rear sides, and are configured to together limit the back-and-forth movement of the first partition frame 132 with respect to the guiding element 12*b*.

An outer surface of each of the guiding elements 12*b* is butted against the corresponding second side wall 11*b*. In this way, when the first partition frame 132 tends to move leftward or rightward with respect to the body 11, one of the guiding elements 12*b* may limit the tendency of leftward movement of the first partition frame 132 by butting against the corresponding second side wall 11*b*, and the other of the guiding elements 12*b* may limit the tendency of rightward movement of the first partition frame 132 by butting against the corresponding second side wall 11*b*.

In the present embodiment, the guiding mechanism 12 is provided at an exterior of the body 11 away from the accommodation cavity 10, specifically outside the corresponding second side wall 11*b*. An inner side of each of the guiding elements 12*b* abuts against the corresponding second side wall 11*b* respectively, thereby enhancing the stability of the guiding element 12*b* when sliding, and preventing the first partition frame 132 from swaying from side to side with respect to the body 11 in use.

Each of the second side walls 11*b* is provided thereon with a guide groove 11*c* extending in the front-rear direction. The left and right ends of the first partition frame 132 pass through the guide groove 11*c* and then are connected onto the guiding mechanism 12. Specifically, the fixing portion 132*d* passes through the guide groove 11*c* from the accommodation cavity 10, and then is fitted and connected into the mounting hole 12*d* of the guiding element 12*b*.

Referring to FIGS. 1 to 3, the second partition frame 131 is accommodated in the accommodation cavity 10 for dividing the accommodation cavity 10 in the left-right direction. In the present embodiment, the second partition frame 131 is rotatably connected onto the first partition frame 132 around a vertical axis t through a regulating assembly 14. According to the positional relation between the second partition frame 131 and the first partition frame 132, the storage device 100 has a folded state (referring to FIG. 1) and an unfolded state (referring to FIG. 3). By rotatably connecting the second partition frame 131 onto the first partition frame 132, the number of storage partitions formed by dividing the accommodation cavity 10 may be adjusted, and the flexibility of dividing the accommodation cavity 10 is improved.

The second partition frame 131 includes a partition body for dividing the accommodation cavity 10, and the vertical plane where the partition body is located is defined as the partition plane of the second partition frame 131. A transverse width of the accommodation cavity 10 (that is, a spacing between the pair of second side walls 11*b*) is greater than a longitudinal width of the accommodation cavity 10 (that is, a spacing between the pair of first side walls 11*a*). Correspondingly, the width of the partition plane of the first partition frame 132 is greater than that of the partition plane of the second partition frame 131, i.e., a length of the partition element is greater than that of the partition body.

In the present embodiment, the partition body includes long longitudinal partition bars 131*a* and 131*b* which are parallel with each other and arranged spaced apart from each other in the vertical direction.

Referring to FIG. 1, when the storage device 100 is in the folded state, the partition plane of the second partition frame 131 is coplanar with the partition plane of the first partition frame 132. The longitudinal partition bars 131*a*, 131*b* and the transverse partition bars 132*a*, 132*b* all extend in the left-right direction and are located in the same vertical plane. In this way, the occupied space of the second partition frame 131 not in use may be reduced, and the cleanliness and aesthetic degree are improved. Referring to FIG. 3, when the storage device 100 is in the unfolded state, the second partition frame 131 is crossed with the first partition frame 132, the accommodation cavity 10 may be divided in the front-rear direction by taking the partition plane of the first partition frame 132 as a boundary, and in the left-right direction by taking the partition plane of the second partition frame 131 as a boundary. At this point, a non-zero included angle is formed between the partition plane of the second partition frame 131 and the partition plane of the first partition frame 132. In the present embodiment, at this point, the partition plane of the second partition frame 131 is perpendicular to the partition plane of the first partition frame 132. Specifically, the longitudinal partition bars 131*a*, 131*b* extend in the front-rear direction, the transverse partition bars 132*a*, 132*b* extend in the left-right direction, and the longitudinal partition bars 131*a*, 131*b* are perpendicular to the transverse partition bars 132*a*, 132*b*.

Further, the partition element may further include a glass partition plate 133*a*, which is selectively assembled by a user between the first fixing element 133*b* and the second fixing element 133*e*. The partition plate 133*a* is assembled onto the connector 132*c* through the first fixing element 133*b*, and is detachably connected onto the regulating assembly 14 through the second fixing element 133*e*. By providing the partition plate 133*e*, the articles stored in the storage partitions at front and rear sides of the first partition frame 132 are not in contact, which avoids tainting, and prevents the stored articles from sliding down crossly from between the transverse partition bars 132*a* and 132*b*. Certainly, in a variation, the partition plate 133*e* is not only located between the transverse partition bars 132*a* and 132*b*, but also partially extends upwards to above the transverse partition bar 132*a*, and/or partially extends downwards to below the transverse partition bar 132*b*.

In the vertical direction, the longitudinal partition bars 131*a* and 131*b* are arranged adjacent to each other, the longitudinal partition bar 131*a* is higher than an upper boundary of the partition element all along (in the present embodiment, the transverse partition bar 132*a*), and the longitudinal partition bar 131*b* is lower than a lower boundary of the partition element all along (in the present embodiment, the transverse partition bar 132*b*). The longitudinal partition bar 131*a*, the transverse partition bars 132*a*, the partition plate 133*a*, the transverse partition bar 132*b*, and the longitudinal partition bar 131*b* are arranged sequentially in the vertical direction. In this way, when the storage device 100 is in the folded state, the second partition frame 131 does not interfere with the partition plate 133*a*.

Further, the second partition frame 131 may also slidably connected onto the first partition frame 132 through the regulating assembly 14, i.e., the second partition frame 131 is not only slidable with respect to the first partition frame 132, but also rotatable around the vertical axis t, thereby adjusting the number and/or size of the storage partitions formed by dividing the accommodation cavity 10 as needed.

The above-mentioned second partition frame 131 may be slidably connected onto the first partition frame 132 through the regulating assembly 14 in a plurality of manners. Firstly, the first partition frame 132 is not slidably connected to the regulating assembly 14, and the second partition frame 131 is slidably connected to the regulating assembly 14, thereby adjusting the size/number of the storage partitions formed by dividing the accommodation cavity 10 by the first partition frame 132 in the front-rear direction; secondly, the first partition frame 132 is slidably connected to the regulating assembly 14, and the second partition frame 131 is not slidably connected to the regulating assembly 14, thereby adjusting the size/number of the storage partition formed by dividing the accommodation cavity 10 by the second partition frame 131 in the left-right direction; thirdly, as in the present embodiment, the first partition frame 132 is slidably connected to the regulating assembly 14, and the second partition frame 131 is also slidably connected to the regulating assembly 14, thereby regulating the size/number of the storage partitions formed by dividing the accommodation cavity 10 by the first and second partition frames 132 and 131 in the front-rear direction and the left-right direction, and further improving the flexibility.

The specific structure of the regulating assembly 14 will be described in detail below with reference to FIGS. 4*a*-5. In the present embodiment, the regulating assembly 14 is provided as a cylindrical structure with mirror symmetry along a horizontal plane q. Certainly, in the variation, its shape and structure are not limited to the present embodiment.

The regulating assembly 14 includes a first regulating mechanism and a second regulating mechanism. The first regulating mechanism is fitted and connected with one of the first and second partition frames 132 and 131, and the second regulating mechanism is fitted and connected with the other of the first and second partition frames 132 and 131. In the present embodiment, the first regulating mechanism is fitted and connected with the first partition frame 132, and two first regulating mechanisms are provided, i.e., the first regulating mechanism 142*a* which is fitted and connected with the transverse partition bar 132*a* and the first regulating mechanism 142*b* which is fitted and connected with the transverse partition bar 132*b*; the second regulating mechanism is fitted and connected with the second partition frame 131, and two second regulating mechanisms are provided, i.e., the second regulating mechanism 141*a* which is fitted and connected with the longitudinal partition bar 131*a* and the second regulating mechanism 141*b* which is fitted and connected with the longitudinal partition bar 131*b*; the first regulating mechanism 142*b* is matched with the second regulating mechanism 141*b*, and the first regulating mechanism 142*b* is matched with the second regulating mechanism 141*b*.

The first regulating mechanism 142*a* includes a third member 43*a*, a fourth member 44*a*, and a first passage 145*a*. The third member 43*a* includes two hooks 434*a* and a groove 433*a*; the fourth member 44*a* includes two slots 441*a* and a groove 442*a*; the two hooks 434*a* are fastened and connected with the two slots 441*a* in one-to-one correspondence, such that the third member 43*a* and the fourth member 44*a* are fitted and connected with each other; the first passage 145*a* is formed between the third member 43*a* and the fourth member 44*a*, and is specifically enclosed by the grooves 433*a* and 442*a*, thereby conveniently matching and connecting the first regulating mechanism 142*a* with the transverse partition bar 132*a*. The transverse partition bar 132*a* passes through the first passage 145*a*, such that the first regulating mechanism 142*a* slides along the transverse partition bar 132*a*.

Similarly, the first regulating mechanism 142*b* is fitted and connected with the transverse partition bar 132*b*, and the specific structure thereof refers to the structure of the first regulating mechanism 142*a*, without repetition herein. The first passage 145*a* is parallel with the first passage 145*b*, and the regulating assembly 14 is slidably connected to the first partition frame 132 in the left-right direction.

The second regulating mechanism 141*a* includes a first member 41*a*, a second member 42*a*, and a second passage 144*a*. The first member 41*a* includes two hooks 411*a* and a groove 412*a*; the second member 42*a* includes two slots 421*a* and a groove 422*a*; the two hooks 411*a* are fastened and connected with the two slots 421*a* in one-to-one correspondence, such that the first member 41*a* and the second member 42*a* are fitted and connected with each other; the second passage 144*a* is formed between the first member

41*a* and the second member 42*a*, and is specifically enclosed by the grooves 422*a* and 412*a*, thereby conveniently matching and connecting the second regulating mechanism 141*a* with the longitudinal partition bar 131*a*. The longitudinal partition bar 131*a* passes through the second passage 144*a*, such that the second regulating mechanism 141*a* slides along the longitudinal partition bar 131*a*.

Similarly, the second regulating mechanism 141*b* is fitted and connected with the longitudinal partition bar 131*b*, and the specific structure thereof refers to the structure of the second regulating mechanism 141*a*, without repetition herein. The second passage 141*a* is parallel with the second passage 141*b*, and the regulating assembly 14 is slidably connected to the second partition frame 131.

Further, the first regulating mechanism 142*a* includes a mating pin 432*a*, and the second regulating mechanism 141*a* includes a mating hole matched with the mating pin 432*a*; the mating pin 432*a* may be insertably fitted with the mating hole of the second regulating mechanism 141*a* in the vertical direction, and the mating pin 432*a* and the mating hole have matched cylindrical mating surfaces, such that the first and second regulating mechanisms 142*a* and 141*a* are fitted and connected and are rotated relatively around the vertical axis t. In the present embodiment, the second regulating mechanism 141*a* is rotated around the vertical axis t (with reference to the body 11). Similarly, the second regulating mechanism 141*b* includes a mating hole 424*b*, and the first regulating mechanism 142*b* includes a mating pin matched with the mating hole 424*b*; the mating hole 424*b* may be insertably fitted with the mating pin of the first regulating mechanism 142*b* in the vertical direction, and the mating hole 424*b* and the mating pin have matched cylindrical mating surfaces, such that the first and second regulating mechanisms 142*b* and 141*b* are fitted and connected and are rotated relatively around the vertical axis t. In the embodiment, the second regulating mechanism 141*b* is rotated around the vertical axis t (with reference to the body 11).

Moreover, when the mating holes of the mating pin 432*a* and the second regulating mechanism 141*a* are fitted and connected, the two are limited mutually, such that the relative displacement of the first and second regulating mechanisms 142*a* and 141*a* in the horizontal direction is limited, thereby avoiding shaking. Similarly, when the mating hole 424*b* is fitted and connected with the mating pin of the first regulating mechanism 142*b*, the two are limited mutually, such that the relative displacement of the first and second regulating mechanisms 142*b* and 141*b* in the horizontal direction is limited, thereby avoiding shaking.

In this way, with the relative rotation of the first regulating mechanisms 142*a*, 142*b* and the second regulating mechanisms 141*a*, 141*b*, the first and second partition frames 132 and 131 are rotated around the vertical axis t with respect to each other, so that the storage device 100 is switched between the folded state and the unfolded state.

Specifically, the regulating assembly 14 further includes a cam structure formed between the first and second regulating mechanisms. In the present embodiment, the number of the cam structures is two, i.e., the cam structure 143*a* formed between the first and second regulating mechanisms 142*a* and 141*a*, and the cam structure 143*b* formed between the first and second regulating mechanisms 142*b* and 141*b*. Certainly, in the variation, only one of the cam structures 143*a* and 143*b* may be provided.

Taking the cam structure 143*a* as an example, the specific structure of the cam structure will be described (the specific structure of the cam structure 143*b* refers to that of the cam structure 143*a*, and will not be repeated herein). The cam structure 143*a* includes a first concave-convex curved surface 431*a* with a circumferentially-waved shape formed on an upper end surface of the first regulating mechanism 142*a*, and a second concave-convex curved surface 432*a* with a circumferentially-waved shape formed on a lower end surface of the second regulating mechanism 141*a*, the first and second concave-convex curved surfaces 431*a* and 423*a* are fitted with each other; and when the first and second regulating mechanisms 142*a* and 141*a* are rotated around the vertical axis t with respect to each other, the second and first concave-convex curved surfaces 423*a* and 431*a* are butted against each other, such that the first and second regulating mechanisms 142*a* and 141*a* make reciprocating salutatory movements away from or close to each other in the vertical direction.

The cam structure 143*a* has at least two lowest engaging positions (referring to FIGS. 4*a* and 4*c*) where the second and first concave-convex curved surfaces 423*a* and 431*a* are fitted with each other concavely and convexly, and a highest butting position (referring to FIG. 4*b*) where the second and first concave-convex curved surfaces 423*a* and 431*a* are butted against each other concavely and convexly. When the cam structure 143*a* is moved from the lowest engaging position to the highest butting position, the first and second regulating mechanisms 142*a* and 141*a* are away from each other in the vertical direction; when the cam structure 143*a* is moved from the highest butting position to the lowest engaging position, the first and second regulating mechanisms 142*a* and 141*a* are close to each other in the vertical direction.

When the second partition frame 131 is rotated around the vertical axis t with respect to the first partition frame 132, by taking the process of changing the storage device 100 from the folded state to the unfolded state (contrary to the process of changing the storage device 100 from the unfolded state to the folded state) as an example:

referring to FIG. 4*a*, when the storage device 100 is in the folded state, the regulating assembly 14 is in a first engaging state; at this point, the first passages 145*a*, 145*b* are parallel with the second passages 144*a*, 144*b*; correspondingly, the partition plane of the first partition frame 132 is parallel with that of the second partition frame 131, and the cam structures 143*a*, 143*b* are both at one of the lowest engaging positions;

referring to FIG. 4*b*, when the storage device 100 is switched from the folded state to the unfolded state, during the process that the regulating assembly 14 changes from the first engaging state into a critical state, the cam structures 143*a*, 143*b* are both moved from the lowest engaging position to the highest butting position, the first and second regulating mechanisms 142*a* and 141*a* are away from each other in the vertical direction, and the first and second regulating mechanisms 142*b* and 141*b* are away from each other in the vertical direction, until the regulating assembly 14 is in the critical state, and the cam structures 143*a*, 143*b* are both at the highest butting position; and then, during the process that the regulating assembly 14 changes from the critical state into the second engaging state, the first and second regulating mechanisms 142*a* and 141*a* are close to each other in the vertical direction, and the first and second regulating mechanisms 142*b* and 141*b* are close to each other in the vertical direction;

referring to FIG. 4*c*, when the storage device 100 is in the unfolded state, the regulating assembly 14 is in the second engaging state; at this point, the first passages 145*a*, 145*b* are perpendicular to the second passages 144*a*, 144*b*; correspondingly, the partition plane of the first partition frame 132 is perpendicular to that of the second partition frame 131, and the cam structures 143*a*, 143*b* are both at the other of the lowest engaging positions.

Further, the cam structures 143*a*, 143*b* are both configured as a circumferentially quartering structure, i.e., when the cam structures 143*a*, 143*b* are changed between the two adjacent lowest engaging positions, the first and second regulating mechanism 142*a* and 141*a* are rotated with respect to each other by 90° around the vertical axis t, and the first and second regulating mechanisms 142*b* and 141*b* are rotated with respect to each other by 90° around the vertical axis t. Further, the second partition frame 131 is rotated by 90° with respect to the first partition frame 132 around the vertical axis t, such that the storage device 100 is switched between the folded state and the unfolded state to finish a turnover cycle.

At the same time, when the cam structures 143*a*, 143*b* are changed between the lowest engaging position and the highest butting position, the first and second regulating mechanisms 142*a* and 141*a* are rotated with respect to each other by 45° around the vertical axis t, and the first and second regulating mechanisms 142*b* and 141*b* are rotated with respect to each other by 45° around the vertical axis t.

Certainly, in the variation, the cam structures 143*a*, 143*b* may also be configured as circumferentially inequant or multi-equant structures (such as the structure divided into three, five, six, eight equal parts, or the like) according to the specific requirements of a rotation angle of the storage device 100 switched from the folded state to the unfolded state. These variations do not deviate from the technical principle of the present invention.

Further, when the cam structures 143*a*, 143*b* are not at the lowest engaging position, the regulating assembly 14 is always subjected to an elastic driving force which drives the cam structures 143*a*, 143*b* to move to the lowest engaging position, i.e., the elasticity driving force drives the first and second regulating mechanisms 142*a* and 141*a* to have a tendency to be close to each other in the vertical direction and drives the first and second regulating mechanisms 142*b* and 141*b* to have a tendency to be close to each other in the vertical direction.

In the present embodiment, the elastic driving force is provided by the second partition frame 131. Specifically, the second partition frame 131 is made of a rigid material, and further includes a pair of connecting rods 131*c* for connecting the end portion of the longitudinal partition bar 131*a* and the end portion of the longitudinal partition bar 131*b*; the fourth member 44*a* and the fourth member 44*b* are integrally formed, the fourth member 44*a* is provided as an upper half part of a structural element 44, and the fourth member 44*b* is provided as a lower half part of the member 44, such that the first regulating mechanisms 142*a*, 142*b* are fixedly connected in the vertical direction. When the cam structures 143*a*, 143*b* are at the lowest engaging position, the second partition frame 131 is not elastically deformed, and the longitudinal partition bars 131*a*, 131*b* are parallel with each other and have an initial spacing; when the cam structures 143*a*, 143*b* are not at the lowest engaging position (including between the lowest engaging position and the highest butting position and at the highest butting position), driven by the second regulating mechanisms 141*a*, 141*b*, a local spacing of the longitudinal partition bars 131*a*, 131*b* close to the regulating assembly 14 is greater than the initial spacing, and the initial spacing is maintained at the end portion by the pulling of the connecting rod 131*c*, and then the second partition frame 131 is elastically deformed, and applies the elastic driving force onto the regulating assembly 14.

In this way, in one turnover cycle of the storage device 100 switched between the folded state and the unfolded state: under the action of an external force, the second partition frame 131 is rotated with respect to the first partition frame 132 around the vertical axis t, the regulating assembly 14 is changed from the first engaging state to the critical state (or from the second engaging state to the critical state), the cam structures 143*a*, 143*b* are both moved from the lowest engaging position to the highest butting position, the second regulating mechanisms 141*a*, 141*b* are away from each other in the vertical direction to drive the second partition frame 131 to be elastically deformed; when the regulating assembly 14 reaches the critical state, the cam structures 143*a*, 143*b* are both at the highest butting position, the second partition frame 131 is elastically deformed furthest; over the critical state, under the elastic restoring force of the second partition frame 131, the second regulating mechanisms 141*a*, 141*b* are close to each other in the vertical direction, and the regulating assembly 14 is changed from the critical state to the second engaging state (or from the critical state to the first engaging state), such that the storage device 100 is changed from the folded state to the unfolded state (or from the unfolded state to the folded state).

Certainly, in the variation, the storage device 100 may further include an elastic element which provides the elastic driving force, and the elastic element is provided between the first and second regulating mechanisms. When the cam structure is not at the lowest engaging position, the elastic element is elastically deformed.

Further, the connecting rod 131*c* is provided not to be coplanar with the longitudinal partition bars 131*a*, 131*b*. When the storage device 100 is in the folded state, the pair of connecting rods 131*c* abut against the transverse partition bars 132*a* and 132*b* and are located at front and rear sides of the first partition frame 132 respectively.

Compared with the prior art, the storage device 100 according to the present embodiment may adjust the number/size of the storage partitions formed by dividing the accommodation cavity 10 as needed. For example, with the movements of the first partition frame 132 and/or the second partition frame 131, the area without partition as shown in FIG. 6*a*, the area with two partitions in FIG. 6*b* or 1, and the area with four partitions in FIG. 3 is formed, or by detaching or replacing the second partition frame 131, the area with three partitions as shown in FIG. 6*c* is formed; and the first partition frame 132 is convenient to be disassembled and assembled, and has good stability in use; the storage partitions formed by dividing the first partition frame 132 may prevent articles from falling down crosswise.

Certainly, in the variation, there may be provided one first regulating mechanism, and its upper and lower ends are fitted and connected with one of the second regulating mechanisms; or the two second regulating mechanisms are fixedly connected in the vertical direction, and the two first regulating mechanisms are separately disposed, and when the regulating assembly is changed from the first engaging state to the critical state, the two first regulating mechanisms are moved close to each other in the vertical direction. None of these variations departs from the technical principle of the present invention.

Embodiment 2

Referring to FIGS. 7 to 15*b*, the present embodiment provides a storage device 300, including a body 31, a pair of guiding mechanisms 32, a first partition frame 332, a second partition frame 331 and a regulating assembly 34.

Enclosed by the body 31, an accommodation cavity 30 has an upper opening and is rectangular parallelepiped substantially, for storing various articles, such as food, beverage, or the like. The body 31 includes a bottom wall, a pair of first side walls 31*a* arranged opposite to each other, and a pair of second side walls 31*b* arranged opposite to each other. The bottom wall is configured for carrying articles, and the pair of first side walls 31*a* and the pair of second side walls 31*b* extend perpendicularly upwards from the bottom wall respectively. One first side wall 31*a* also functions as a door of the storage compartment.

In order to clearly express the position and direction described in the present embodiment, the direction defined by a relative position of the pair of first side walls 31*a* is referred to as a front-rear direction (also as a longitudinal direction), and the direction defined by a relative position of the pair of second side walls 31*b* is referred to as a left-right direction (also as a lateral direction). That is, the pair of first side walls 31*a* is arranged front to back, and the pair of second side walls 31*b* is arranged left and right. In addition, the plane defined both by the front-rear direction and the left-right direction is defined as a horizontal plane, and the direction perpendicular to the horizontal plane is defined as a vertical direction.

Referring to FIGS. 7 to 9, the pair of guiding mechanisms 32 is arranged at the pair of second side walls 31*b* respectively. The guiding mechanism 32 includes a guide bar 32*a*, a guiding element 32*b* and fixing bases 32*c*, wherein the guiding mechanism 32 is fixed on the body 31 through the fixing bases 32*c*, the fixing bases 32*c* are fixed with the body 31 in a threaded connection, rivet connection, fastener connection, or the like; parallel with the second side wall 31*b*, the guide bar 32*a* extends in the front-rear direction and is provided to have a shape of a cylindrical long bar; the guiding element 32*b* includes a guiding body 320*b* and a pair of brackets 321*b* with through holes 322*b* respectively, the through holes 322*b* are matched with the guide bar 32*a*, the guide bar 32*a* is sleeved with the guiding element 32*b* through the through holes 322*b*, and the guiding element 32*b* may slide back and forth along the guide bar 32*a*.

The first partition frame 332 is accommodated in the accommodation cavity 30, for dividing the accommodation cavity 30 in the front-rear direction. Specifically, the first partition frame 332 includes a partition element laterally arranged (i.e., extending in the left-right direction) in the accommodation cavity 30 for dividing the accommodation cavity 30, the vertical plane where the partition element is located is defined as a partition plane of the first partition frame 332, and the accommodation cavity 30 is divided in the front-rear direction by taking the partition plane of the first partition frame 332 as a boundary. The partition element includes long transverse partition bars 332*a* and 332*b* which extend left and right and are arranged spaced apart from each other in the vertical direction.

The first partition frame 332 further includes a pair of connectors 332*c* which is configured for connecting an end portion of the transverse partition bar 332*a* with an end portion of the transverse partition bar 332*b*, and enclosing a rectangular frame together with the transverse partition bars 332*a*, 332*b*.

The first partition frame 332 is slideably connected onto the body 31 in the front-rear direction through the guiding mechanism 32. The sliding of the first partition frame 332 may adjust the size and/or number of the storage partitions formed by dividing the accommodation cavity 30 in the front-rear direction, so as to meet diversified demands from different stored articles.

Specifically, referring to FIGS. 9-11, the first partition frame 332 includes a pair of fixing portions 332*b* formed at left and right ends of the first partition frame 332 and a limited portion 332*e*; the guiding element 32*b* includes a hook 323*b*, a mounting portion, a limiting portion 325*b* and an opening 326*b* extending out of the guiding body 320*b*.

Specifically, the fixing portion 332*d* is provided to be a long bar extending in the front-rear direction, the mounting portion is provided to be a mounting groove 324*b* which is enclosed by the hook 323*b* and extends in the front-rear direction, and the fixing portion 332*d* is fastened in the mounting groove 324*b* in the first direction through the opening 326*b*. The first direction is perpendicular to the front-rear direction, and in the present embodiment, refers to a diagonally downward direction. When the fixing portion 332*d* is fastened in the mounting groove 324*b*, the first partition frame 332 is slideably connected onto the guiding element 32*b* synchronously, and at this point, the fixing portion 332*d* and the mounting groove 324*b* are limited mutually in the left-right direction, such that the fixing portion 332*d* cannot move left and right with respect to the guiding element 32*b*.

The limiting portion 325*b* is matched with the limited portion 332*e*. When the fixing portion 332*d* is fastened in the mounting groove 324*b*, the limiting portion 325*b* is fitted and connected with the limited portion 332*e*, to limit the first partition frame 332 from moving back and forth with respect to the guiding element 32*b*. In this way, the first partition frame 332 is stably connected with the guiding element 32*b*, to prevent the first partition frame 332 from wobbling.

In the present embodiment, the fixing portion 332*d* is connected with the limited portion 332*e* to form a T-shaped structure.

The limiting portion 325*b* is a U-shaped notch which is recessed on the hook 323*b* from the opening 326*b*. When the fixing portion 332*d* is fastened in the mounting groove 324*b*, the limited portion 332*e* is fitted into the notch and is butted against the front and rear side surfaces of the notch, thereby limiting the first partition frame 332 with respect to the guiding element 32*b* in the front-rear direction.

Further, the guiding element 32*b* further has an inclined guiding surface 327*b* arranged at the opening 326*b*, so as to guide the fixing portion 332*d* to smoothly pass through the opening 326*b* to be fastened into the mounting groove 324*b*.

In the present embodiment, the hook 323*b* is provided to be an elastic structure; the fixing portion 332*d* is provided to be a cylindrical bar with a diameter of D. In the first direction, an aperture of the opening 326*b* decreases gradually to a minimal value W, wherein W<D. In this way, when the fixing portion 332*d* is fitted and connected in the mounting groove 324*b* through the opening 326*b*, the hook 323*b* is elastically deformed by being butted against the fixing portion 332*d*, until the fixing portion 332*d* is matched and stably kept in the mounting groove 324*b* under the action of an elastic self-resilience of the hook 232*b*.

Further, referring to FIG. 12, the body 31 further includes an auxiliary element 31*e* with a fitting cavity 311*e* and a mounting cavity 312*e*. A top end of the second side wall 31*b* may be accommodated in the fitting cavity 311*e* from the bottom up to suspend the auxiliary element 31*e* on the second side wall 31*b*, thereby detachably connecting the auxiliary element 31*e* onto the second side wall 31*b*. When the auxiliary element 31*e* is assembled onto the second side wall 31*b*, the mounting cavity 312*e* is located in and communicated with the accommodation cavity 30 of the storage device 300 through a lower port 3120*e*; the guiding mechanism 32 may be assembled onto the auxiliary element 31*e* and accommodated in the accommodation cavity 312*e*. In this way, the guiding mechanism 32 may be firstly connected with the first partition frame 331, and then with the auxiliary element 31*e*, after which, the auxiliary element 31*e* carrying the guiding mechanism 32 and the first partition frame 331 is suspended onto the second side wall 31*b*, thereby finishing the assembly, which is convenient and rapid. Certainly, in other embodiments, the mounting cavity may also be provided to be enclosed by both the auxiliary element and the second side wall.

The second partition frame 331 is accommodated in the accommodation cavity 30 for dividing the accommodation cavity 30 in the left-right direction. In the present embodiment, the second partition frame 331 is rotatably connected onto the first partition frame 332 around a vertical axis t2 through a regulating assembly 34. According to the positional relation between the second partition frame 331 and the first partition frame 332, the storage device 300 has a folded state and an unfolded state (referring to FIG. 7). By rotatably connecting the second partition frame 331 onto the first partition frame 332, the number of storage partitions formed by dividing the accommodation cavity 30 may be adjusted, and the flexibility of dividing the accommodation cavity 30 is improved.

The second partition frame 331 includes a partition body for dividing the accommodation cavity 30, and the vertical plane where the partition body is located is defined as the partition plane of the second partition frame 331. A transverse width of the accommodation cavity 30 (that is, a spacing between the pair of second side walls 31*b*) is greater than a longitudinal width of the accommodation cavity 30 (that is, a spacing between the pair of first side walls 31*a*). Correspondingly, the width of the partition plane of the first partition frame 332 is greater than that of the partition plane of the second partition frame 331, i.e., a length of the partition element is greater than that of the partition body.

In the present embodiment, the partition body includes long longitudinal partition bars 331*a* and 33 lb which are parallel with each other and arranged spaced apart from each other in the vertical direction.

When the storage device 300 is in the folded state, the partition plane of the second partition frame 331 is coplanar with the partition plane of the first partition frame 332. The longitudinal partition bars 331*a*, 331*b* and the transverse partition bars 332*a*, 332*b* all extend in the left-right direction and are located in the same vertical plane. In this way, the occupied space of the second partition frame 331 not in use may be reduced, and the cleanliness and aesthetic degree are improved. Referring to FIG. 7, when the storage device 300 is in the unfolded state, the second partition frame 331 is crossed with the first partition frame 332, the accommodation cavity 30 may be divided in the front-rear direction by taking the partition plane of the first partition frame 332 as a boundary, and in the left-right direction by taking the partition plane of the second partition frame 331 as a boundary. At this point, a non-zero included angle is formed between the partition plane of the second partition frame 331 and the partition plane of the first partition frame 332. In the present embodiment, at this point, the partition plane of the second partition frame 331 is perpendicular to the partition plane of the first partition frame 332. Specifically, the longitudinal partition bars 331*a*, 331*b* extend in the front-rear direction, the transverse partition bars 332*a*, 332*b* extend in the left-right direction, and the longitudinal partition bars 331*a*, 331*b* are perpendicular to the transverse partition bars 332*a*, 332*b*.

Further, the partition element may further include a glass partition plate (not shown), which is selectively assembled by a user between the transverse partition bars 332*a* and 332*b*. By providing the partition plate, the articles stored in the storage partitions at front and rear sides of the first partition frame 332 are not in contact, which avoids tainting, and prevents the stored articles from sliding down crossly from between the transverse partition bars 332*a* and 332*b*. Certainly, the partition plate is not only located between the transverse partition bars 332*a* and 332*b*, but also partially extends upwards to above the transverse partition bar 332*a*, and/or partially extends downwards to below the transverse partition bar 332*b*.

Further, in the vertical direction, the longitudinal partition bars 331*a* and 331*b* are arranged adjacent to each other, the longitudinal partition bar 331*a* is higher than an upper boundary of the partition element all along (in the present embodiment, the transverse partition bar 332*a*), and the longitudinal partition bar 331*b* is lower than a lower boundary of the partition element all along (in the present embodiment, the transverse partition bar 332*b*). The longitudinal partition bar 331*a*, the transverse partition bars 332*a*, the partition plate, the transverse partition bar 332*b*, and the longitudinal partition bar 331*b* are arranged sequentially in the vertical direction. In this way, when the storage device 300 is in the folded state, the second partition frame 331 does not interfere with the partition plate.

The second partition frame 331 further includes a pair of connecting rods 331*c* for connecting the end portions of the longitudinal partition bars 331*a* and 331*b*, and the connecting rods 331*c* are provided to be coplanar with the longitudinal partition bars 331*a*, 331*b*. When the storage device 300 is in the folded state, the pair of connecting rods 331*c* abuts against the transverse partition bars 332*a*, 332*b*, and is located at front and rear sides of the first partition frame 332.

Further, the second partition frame 331 may also be slideably connected onto the first partition frame 332 through the regulating assembly 34. That is, the second partition frame 331 is slideable with respect to the first partition frame 332 and rotatable around the vertical axis t2. In this way, on the one hand, the number of storage partitions formed by dividing the accommodation cavity 30 may be adjusted; on the other hand, the size of the storage partition may be adjusted, and the flexibility of dividing the accommodation cavity 30 is improved.

The above-mentioned second partition frame 331 may be slideably connected onto the first partition frame 332 through the regulating assembly 34 in a plurality of manners. Firstly, the first partition frame 332 is not slideably connected to the regulating assembly 34, and the second partition frame 331 is slideably connected to the regulating assembly 34, thereby adjusting the size/number of the storage partition formed by dividing the accommodation cavity 30 by the first partition frame 332 in the front-rear direction; secondly, the first partition frame 332 is slideably connected to the regulating assembly 34, and the second partition frame 331 is not slideably connected to the regulating assembly 34, thereby adjusting the size/number of the storage partitions formed by dividing the accommodation cavity 30 by the second partition frame 331 in the left-right direction; thirdly, as in the present embodiment, the first partition frame 332 is slideably connected to the regulating assembly 34, and the second partition frame 331 is also slideably connected to the regulating assembly 34, thereby regulating the size/number of the storage partitions formed by dividing the accommodation cavity 30 by the first and second partition frames 332 and 331 in the front-rear direction and the left-right direction, and further improving the flexibility.

In the present embodiment, two regulating assemblies 34 are provided, one of which is fitted and connected with the longitudinal and transverse partition bars 331*a*, 332*a*, and the other of which is fitted and connected with the longitudinal and transverse partition bars 331*b*, 332*b*. The structure of the regulating assembly 34 will be introduced below with reference to FIGS. 13 to 15*b* by taking the match and connection with the longitudinal and transverse partition bars 331*a*, 332*a* as an example.

The regulating assembly 34 includes a first regulating mechanism 34*b* and a second regulating mechanism 34*a*. The first regulating mechanism 34*b* is fitted and connected to one of the first and second partition frames 332 and 331, and the second regulating mechanism 34*a* is fitted and connected to the other of the first and second partition frames 332 and 331. In the present embodiment, the first regulation mechanism 34*b* is fitted and connected to the first partition frame 332, and the second regulating mechanism 34*a* is fitted and connected to the second partition frame 331.

The first regulating mechanism 34*b* includes a pivot member 430, a fixing member 440, cushion block members 450 and a first passage 342 formed between the cushion block members 450 and the fixing member 440, wherein the fixing member 440 includes a mounting hole 443, a locating hole 441 and a groove 442, the cushion block member 450 includes a locating pin 451 and a mounting hole 452, the mounting holes 443 and 452 correspond to each other and are in threaded connection with screws 470, the locating pin 451 is inserted in the locating hole 441 to facilitate the assembly and location of the fixing member 440 and the cushion block members 450; the first passage 342 located at the groove 442 is enclosed by the cushion block members 450 and the fixing member 440. The transverse partition bar 332*a* slideably passes through the first passage 342, such that the first regulating mechanism 34*b* is slidably fitted and connected with the transverse partition bar 332*a* in the left-right direction (that is, the first regulating mechanism 34*b* may slide along the transverse partition bar 332*a* in the left-right direction), thereby slideably connecting the regulating assembly 34 onto the first partition frame 332 in the left-right direction.

The second regulating mechanism 34*a* includes an end cover member 410, a sleeve member 420 and a second passage 341 formed therebetween, wherein the end cover member 410 includes a hook 411 and a groove 312, the sleeve member 420 includes a slot 421 matched with the hook 411, and a groove 322; the end cover member 410 and the sleeve member 420 may be fitted and connected in the vertical direction and are fastened and fixed through the hook 411 and the slot 421; the second passage 341 is enclosed by the grooves 412 and 422. The longitudinal partition bar 331*a* slideably passes through the second passage 341, such that the second regulating mechanism 34*a* is slidably fitted and connected with the longitudinal partition bar 331*a* (that is, the second regulating mechanism 34*a* may slide along the longitudinal partition bar 331*a*), thereby slideably connecting the regulating assembly 34 onto the second partition frame 331.

Preferably, the sleeve member 420 further includes an inclined guiding surface 4210 to guide the hook 411 to be smoothly matched connected at the slot 421.

Further, the first regulating mechanism 34*b* is rotatably matched with and connected to the second regulating mechanism 34*a* through the pivot member 430. Specifically, the pivot member 430 includes a member body 432 with a hanging portion 4321 and a matching portion 4322 which are arranged in a shape of steps and are cylindrical respectively; correspondingly, the sleeve member 420 has a mounting passage 424 matched with the pivot member 430, the diameter of the hanging portion 4321 is greater than that of the mounting passage 424, and the diameter of the matching portion 4322 is equal to or slightly less than that of the mounting passage 424. In the assembly, the pivot member 430 may be fitted and connected with the sleeve member 420 vertically downwards from one side (that is, the side close to the end cover member 410) above the sleeve member 420, and the matching portion 4322 penetrates through the mounting passage 424 and the hanging portion 4321 is limited by the sleeve member 420, such that the pivot member 430 is undetachably assembled onto the sleeve member 420 vertically downwards.

The pivot member 430 includes a mated surface 4320 formed at an outer surface of the matching portion 4322, the sleeve member 430 includes a mating surface 4240 formed at an inner wall of the mounting passage 424, and the mating surface 4240 is fitted with the mated surface 4320, such that the pivot member 430 is rotatably fitted in the mounting passage 424. In the present embodiment, the pivot member 430 has a central axis which defines a vertical axis t2.

One end of the matching portion 4322 of the pivot member 430 is provided with a mounting hole 423 which is fitted with the screw 460, such that the pivot member 430 is fixedly connected onto the fixing member 440.

Further, when the first regulating mechanism 34*b* is rotated with respect to the second regulating mechanism 34*a*, driven by the first and second regulating mechanisms 34*b* and 34*a* respectively, the transverse partition bar 332*a* is rotated with respect to the longitudinal partition bar 331*a*, thereby rotating the first partition frame 332 with respect to the second partition frame 331. In the present embodiment, by taking the body 31 as a reference, the second regulating mechanism 34*a* is rotated around the vertical axis t2, while the first regulating mechanism 34*b* is not rotated.

Further, the sleeve member 420 further includes at least two locating grooves 423 recessed on the mating surface 4240 (that is, the inner wall of the mounting passage 424). The matching portion 4322 of the member body 432 is provided with a mating hole 4320 extending horizontally; the pivot member 430 further includes an elastic extensible element 431 connected onto the member body 432, the elastic extensible element 431 is arranged in the mating hole 4320 and at least a part of the elastic extensible element 431 in a free state protrudes from the mated surface 4320 (that is, the outer surface of the matching portion 4322).

When the first regulating mechanism 34*b* is rotated around the vertical axis t2 with respect to the second regulating mechanism 34*a*, at a position between two adjacent locating grooves 423, by being butted against the mating surface 4240, the elastic extensible element 431 is compressed and deformed and contracted towards the mating hole 4320; at the locating groove 423, under the action of the self-resilience, the elastic extensible element 431 at least partially protrudes from the mated surface 4320 and is stuck in the locating groove 423, so as to implement the rotational location of the first and second regulating mechanisms 34*b* and 34*a*.

Specifically, the elastic extensible element 431 includes an elastic portion 4311 penetrating through the mating hole 4320 and balls 4312 arranged at the end portions of the elastic portion 4311 in a rollable manner. When the first regulating mechanism 34*b* is rotated around the vertical axis t2 with respect to the second regulating mechanism 34*a*, at a position between two adjacent locating grooves 423, by being butted against the mating surface 4240, the elastic portion 4311 is compressed and deformed, and the balls 4312 are contracted towards the mating hole 4320 and roll along the mating surface 4240; at the locating groove 423, under the action of the self-resilience of the elastic portion 4311, the balls 4312 protrude from the mated surface 4320 and are stuck in the locating grooves 423, so as to implement the rotational location of the first and second regulating mechanisms 34*b* and 34*a*.

In the present embodiment, four locating grooves 423 are arranged to quarter a circumference. In this way, when the first and second regulating mechanisms 34*b* and 34*a* are rotated around the vertical axis t2 with respect to each other, the balls 4312 move into the other adjacent locating groove 423 from one locating groove 423, such that the storage device 300 is switched between the folded state and the unfolded state correspondingly.

Specifically, when the second partition frame 331 is rotated around the vertical axis t2 with respect to the first partition frame 332, by taking the process of switching the storage device 300 from the folded state to the unfolded state (contrary to the process of switching the storage device 300 from the unfolded state to the folded state) as an example:

referring to FIG. 15*a*, when the storage device 300 is in the folded state, the first passage 342 is parallel with the second passage 341 and both of them extend in the left-right direction (referring to x direction in the drawing); correspondingly, the transverse and longitudinal partition bars 332*a* and 331*a* extend in the left-right direction (referring to the x direction in the drawing), the partition plane of the first partition frame 332 is parallel with that of the second partition frame 331; at this point, the balls 4312 protrude outwards and are fitted into one locating groove 423;

when the storage device 300 is switched to the unfolded state from the folded state (with the body 31 as a reference), the second regulating mechanism 34*a* drives the longitudinal partition bar 331*a* to rotate around the vertical axis t2, and the second partition frame 331 is rotated around the vertical axis t2 with respect to the first partition frame 332; by being butted against the mating surface 4240, the elastic portion 4311 is compressed and deformed, the balls 4312 are contracted towards the mating hole 4320 and disengage from the previous locating groove 423, and subsequently, roll along the mating surface 4240;

referring to FIG. 15*b*, when the storage device 300 is in the unfolded state, the first passage 342 is perpendicular to the second passage 341, the first passage 342 and the transverse partition bar 332*a* keep extending in the left-right direction (referring to the x direction), while the second passage 341 and the longitudinal partition bar 331*a* extend in the front-rear direction (referring to y direction in the drawing), the partition plane of the first partition frame 332 is perpendicular to the partition plane of the second partition frame 331, and at this point, under the action of the self-resilience of the elastic portion 4311, the balls 4312 protrude outwards and are stuck in the other locating groove 423.

Further, in the present embodiment, the mating hole 4320 extends horizontally and runs through the member body 432; two balls 4312 are arranged at two ends of the elastic portion 4311 in a rollable manner respectively. When the first regulating mechanism 34*b* is rotated around the vertical axis t2 with respect to the second regulating mechanism 34*a*, by being butted against the mating surface 4240, the elastic portion 4311 is compressed and deformed, and the two balls 4312 are both contracted towards the mating hole 4320 and roll along the mating surface 4240; at the locating groove 423, under the action of the self-resilience of the elastic portion 4311, the two balls 4312 protrude from the mated surface 4320 and are stuck in corresponding locating grooves 423 synchronously, so as to further reduce a rotational resistance.

Compared with the prior art, the present embodiment has the following advantageous effects. The assembly and disassembly are convenient, the stability during usage is good; the degree of freedom and flexibility of dividing an accommodation cavity 30 are improved to meet different storage demands, the regulating assembly 34 has a delicate structure, the rapid assembly is realized, the first and second partition frames 332 and 331 may be detached/replaced in time to further improve the dividing flexibility; by selectively providing the glass partition plate, the articles in different storage partitions may be prevented from sliding down crossly.

The above detailed description only illustrates the feasible embodiments of the present invention, and is not intended to limit the protection scope of the present invention. Equivalent embodiments or modifications within the scope and spirit of the present invention shall be embraced by the protection scope of the present invention.

What is claimed is:

1. A storage device, comprising a body enclosing an accommodation cavity, a pair of guiding mechanisms and a first partition frame for dividing the accommodation cavity, the body comprising a bottom wall, a pair of first side walls and a pair of second side walls, wherein the pair of guiding mechanisms is arranged at the pair of second side walls respectively, the guiding mechanism comprises a guiding element which slides back and forth with respect to the body, the guiding element comprises a mounting portion and a limiting portion; the first partition frame comprises a partition element, fixing portions and a limited portion, the partition element extends in a left-right direction, for dividing the accommodation cavity, the fixing portions are provided to be long rods extending in a front-rear direction and are formed at two ends of the first partition frame; wherein the fixing portions are fitted and connected with the mounting portion, such that the first partition frame is connected onto the guiding element, and the limiting portion is fitted and connected with the limited portion, such that the first partition frame is prevented from moving back and forth with respect to the guiding element, the mounting portion is provided to be a mounting hole extending in the front-rear direction, the fixing portion is inserted into the mounting hole in a first direction, and the first direction is parallel to the front-rear direction.

2. The storage device according to claim 1, wherein the fixing portion and the limited portion are connected to form an L-shaped structure.

3. The storage device according to claim 1, wherein the guiding element comprises a first guiding element and a second guiding element, the mounting hole is formed on the first guiding element; when the fixing portion is inserted and fitted into the mounting hole, the limiting portion is formed between the first and second guiding elements, and the first and second guiding elements jointly restrict the first partition frame from moving back and forth with respect to the guiding element.

4. The storage device according to claim 3, wherein the guiding mechanism is provided at the exterior of the body away from the accommodation cavity, a guide groove extending in the front-rear direction is provided on the second side wall, and the fixing portion passes through the guide groove from the accommodation cavity and then is inserted and fitted into the mounting hole.

5. The storage device according to claim 1, wherein the fixing portion is connected with the limited portion to form a T-shaped structure.

6. A refrigerator, wherein the refrigerator comprises the storage device according to claim 1.

7. A storage device, comprising a body enclosing an accommodation cavity, a pair of guiding mechanisms and a first partition frame for dividing the accommodation cavity, the body comprising a bottom wall, a pair of first side walls and a pair of second side walls, wherein the pair of guiding mechanisms is arranged at the pair of second side walls respectively, the guiding mechanism comprises a guiding element which slides back and forth with respect to the body, the guiding element comprises a mounting portion and a limiting portion; the first partition frame comprises a partition element, fixing portions and a limited portion, the partition element extends in a left-right direction, for dividing the accommodation cavity, the fixing portions are provided to be long rods extending in a front-rear direction and are formed at two ends of the first partition frame; wherein the fixing portions are fitted and connected with the mounting portion, such that the first partition frame is connected onto the guiding element, and the limiting portion is fitted and connected with the limited portion, such that the first partition frame is prevented from moving back and forth with respect to the guiding element, the guiding element comprises a guiding body, a hook extending out of the guiding body, a mounting groove enclosed by the hook for constituting the mounting portion, and an opening, wherein the mounting groove extends in the front-rear direction, the fixing portion is fastened into the mounting groove through the opening in the first direction, and the first direction is perpendicular to the front-rear direction.

8. The storage device according to claim 7, wherein the limiting portion is a U-shaped notch which is recessed on the hook from the opening, and when the fixing portion is fastened in the mounting groove, the limited portion is fitted into the notch.

9. The storage device according to claim 7, wherein the hook is provided to be an elastic structure; the fixing portion is provided to be a cylindrical bar with a diameter of D; in the first direction, an aperture of the opening decreases gradually to a minimal value W, wherein $W<D$.

* * * * *